US007761046B2

(12) United States Patent
Hiramoto et al.

(10) Patent No.: US 7,761,046 B2
(45) Date of Patent: Jul. 20, 2010

(54) HYBRID PAPER SUPPLY MODULE AND IMAGE FORMING APPARATUS EQUIPPED WITH SUCH HYBRID PAPER SUPPLY MODULE, AND ALSO PAPER SUPPLY MECHANISM AND IMAGE FORMING APPARATUS EQUIPPED WITH SUCH PAPER SUPPLY MECHANISM

(75) Inventors: Yoshiaki Hiramoto, Nara (JP); Susumu Hashimoto, Nara (JP); Shigeru Yoshida, Nara (JP); Takashi Kubo, Kyoto (JP); Yasuaki Fukada, Nara (JP); Yasushi Matsutomo, Nara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 104 days.

(21) Appl. No.: 10/949,303

(22) Filed: Sep. 27, 2004

(65) Prior Publication Data

US 2005/0074266 A1 Apr. 7, 2005

(30) Foreign Application Priority Data

Oct. 2, 2003 (JP) ..... 2003-344583
Oct. 2, 2003 (JP) ..... 2003-344586

(51) Int. Cl.
*G03G 15/00* (2006.01)
*B65H 3/44* (2006.01)
*B65H 1/04* (2006.01)

(52) U.S. Cl. ..... 399/393; 399/392; 271/9.1; 271/9.02

(58) Field of Classification Search ..... 399/391, 399/390, 404, 45, 389, 361, 363, 383, 388, 399/392, 393, 381; 271/3.13, 8.1, 9.01–9.03, 271/9.09, 9.13; *B65H 3/44; G03G 15/00*
See application file for complete search history.

(56) References Cited

U.S. PATENT DOCUMENTS 5,975,515 A * 11/1999 Capri et al. ..... 271/9.11

(Continued)

FOREIGN PATENT DOCUMENTS

JP 57-192546 5/1956

(Continued)

OTHER PUBLICATIONS

Machine Translation of JP 11292335 A.*

(Continued)

*Primary Examiner*—Judy Nguyen
*Assistant Examiner*—Wyn' Q Ha
(74) *Attorney, Agent, or Firm*—Birch, Stewart, Kolasch & Birch, LLP

(57) ABSTRACT

Mechanism unit(s) functioning as automatic-feed cassette(s) and mechanism unit(s) functioning as manual-feed tray(s) together form a single integral module, constituting a hybrid paper supply module. A plurality of hybrid paper supply modules are stacked together to constitute a paper supply mechanism. Manual-feed tray(s) with which manual-feed mechanism unit(s) of respective hybrid paper supply module(s) is or are provided is or are maintained in stored state(s) as a result of electromagnetic attraction produced by electromagnet(s). In correspondence to image forming condition(s), electromagnetic attraction at one electromagnet is terminated, causing manual-feed tray(s) to assume deployed state(s). Furthermore, primary path(s) passing vertically through module interior(s) is or are formed so as to permit transport of recording paper toward printing unit(s) of hybrid device(s) regardless of from which hybrid paper supply module(s) it is that recording paper is taken up.

6 Claims, 14 Drawing Sheets

U.S. PATENT DOCUMENTS

| | | | | | |
|---|---|---|---|---|---|
| 6,035,395 | A * | 3/2000 | Saito | 713/1 |
| 6,053,642 | A * | 4/2000 | Tanaka | 396/568 |
| 6,246,860 | B1 * | 6/2001 | Ohmichi | 399/406 |
| 6,282,388 | B1 * | 8/2001 | Obata | 399/82 |
| 6,474,884 | B2 * | 11/2002 | Chiu | 400/624 |
| 6,674,983 | B2 * | 1/2004 | Enomoto et al. | 399/124 |
| 6,775,515 | B2 * | 8/2004 | Ouchi | 399/393 |
| 6,902,161 | B2 * | 6/2005 | Gordon et al. | 271/161 |
| 2004/0061273 | A1 * | 4/2004 | Yamada et al. | 271/9.09 |

FOREIGN PATENT DOCUMENTS

| | | | | |
|---|---|---|---|---|
| JP | 58130838 | A | * | 8/1983 |
| JP | 60048039 | A | * | 3/1985 |
| JP | 2-50067 | U | | 4/1990 |
| JP | 2-110083 | A | | 4/1990 |
| JP | 3-256942 | A | | 11/1991 |
| JP | 6-127711 | A | | 5/1994 |
| JP | 06166445 | A | * | 6/1994 |
| JP | 6-329306 | A | | 11/1994 |
| JP | 06329306 | A | * | 11/1994 |
| JP | 7-232842 | A | | 9/1995 |
| JP | 11-95504 | A | | 4/1999 |
| JP | 11272030 | A | * | 10/1999 |
| JP | 11292335 | A | * | 10/1999 |
| JP | 2001-34119 | A | | 2/2001 |
| JP | 2001-138576 | A | | 5/2001 |
| JP | 2001-333249 | A | | 11/2001 |
| JP | 2003095454 | A | * | 4/2003 |
| JP | 2003-237990 | | | 8/2003 |
| JP | 2003237990 | A | * | 8/2003 |

OTHER PUBLICATIONS

Machine Translation of JP 11292335 A, Nov. 4, 2009.*

* cited by examiner

HYBRID PAPER SUPPLY MODULE AND IMAGE FORMING APPARATUS EQUIPPED WITH SUCH HYBRID PAPER SUPPLY MODULE, AND ALSO PAPER SUPPLY MECHANISM AND IMAGE FORMING APPARATUS EQUIPPED WITH SUCH PAPER SUPPLY MECHANISM

This application claims priority under 35 USC 119(a) to Patent Application No. 2003-344583 and Patent Application No. 2003-344586, both of which were filed in Japan on 2 Oct. 2003, the content of both which is incorporated herein by reference in its entirety.

BACKGROUND OF INVENTION

1. Field of the Invention

The present invention relates to a paper supply module with which a copier, printer, facsimile machine, or other such image forming apparatus might be equipped, and to an image forming apparatus equipped with such a paper supply module; and also to a paper supply mechanism with which same might be equipped, and to an image forming apparatus equipped with such a paper supply mechanism. In particular, the present invention relates to improvements in paper supply modules and paper supply mechanisms constructed so as to permit reduction in the amount of space required for image forming apparatus installation and/or reduction in the frequency of occurrence of paper jams.

2. Description of the Related Art

Copiers, printers, facsimile machines, and other such image forming apparatuses—as well as hybrid devices equipped with a plurality of such functions in combination—have conventionally been equipped with automatic-feed cassettes and manual-feed trays serving as containers for (platforms for placement of) recording paper to be fed to image forming units (printing units) equipped with photosensitive drums and the like. When several hundred sheets of recording paper are, for example, loaded into an automatic-feed cassette and image formation is carried out on this recording paper, the recording paper might be sequentially taken up from the automatic-feed cassette and fed to an image forming unit. On the other hand, when a user places recording paper (e.g., postcard stock or the like) on a manual-feed tray and causes initiation of image forming operations, recording paper on this manual-feed tray might be fed to an image forming unit.

Image forming apparatuses equipped with such automatic-feed cassette(s) and manual-feed tray(s) are, for example, disclosed at Japanese Patent Application Publication Kokai No. 2001-138576 and Japanese Patent Application Publication Kokai No. 2001-333249. As disclosed in these references, the automatic-feed cassette has heretofore typically been provided at the lowermost part of the apparatus, with the paper supply path extending from the discharge side of this automatic-feed cassette to the image forming unit. Furthermore, the manual-feed tray, being attached to a side wall of the image forming apparatus, has communicated with an intermediate location along the foregoing paper supply path by way of a paper pickup mechanism for taking up recording paper from this manual-feed tray.

FIG. 14 shows in schematic fashion the internal constitution of a typical conventional copier. At this FIG. 14, a is an automatic-feed cassette; b is a manual-feed tray; c is an image forming unit equipped with a photosensitive drum and so forth; d is a paper supply path extending from automatic-feed cassette a; and e is a paper pickup mechanism for taking up recording paper from manual-feed tray b.

As can be seen in FIG. 14, in the case of a paper supply system having layout as mentioned above in which automatic-feed cassettes a are provided at the lowermost part of an image forming apparatus and manual-feed tray b is provided at a side wall of the image forming apparatus, paper pickup mechanism e for manual-feed tray b is arranged to one side of paper supply path d (i.e., at the side thereof nearer to the apparatus side wall), and paper supply path d extends from automatic-feed cassette a so as to be directed toward image forming unit c; meaning that manual-feed tray b will, moreover, be arranged to one side of paper pickup mechanism e. In other words, the aforementioned paper pickup mechanism e and manual-feed tray b are arranged, in that order as one goes toward the exterior horizontally, to one side of paper supply path d; the presence of these meaning that there has been a limit to the degree to which it has been possible to reduce the amount of space required for installation of the image forming apparatus. In the case of this image forming apparatus shown in FIG. 14, were it not for manual-feed tray b and paper pickup mechanism e the amount of space required for installation of the apparatus would only be dimension I shown in the drawing, but due to the fact that manual-feed tray b and paper pickup mechanism e are actually present the amount of space required for installation of the apparatus is dimension II.

At the same time, developments have in recent years been underway in efforts to achieve reduction in the amount of space required for installation of the apparatus by arranging the automatic-feed cassette at the lower portion of the apparatus and arranging the original capturing unit (scanning unit) at the upper portion of the apparatus, and by disposing the image forming unit and discharge unit (discharge tray) between this automatic-feed cassette and this original capturing unit so as to avoid situations in which the discharge tray protrudes from the side of the apparatus.

FIG. 15 shows in schematic fashion an image forming apparatus having such a layout. At this FIG. 15 as well, a is an automatic-feed cassette; b is a manual-feed tray; c is an image forming unit; d is a paper supply path; and e is a paper pickup mechanism. In the case of an image forming apparatus having such a layout, because the aforementioned paper pickup mechanism e and manual-feed tray b are arranged, in that order as one goes toward the exterior horizontally, at the peripheral region near the side wall of the apparatus, as was the case in the above situation there has here as well been a limit to the degree to which it has been possible to reduce the amount of space required for installation.

In particular, given such a layout, it will be necessary to arrange flipping transport path (switchback transport path) f, for flipping of recording media when carrying out double-sided printing, to one side of paper supply path d. And in the case of a layout in which the aforementioned paper pickup mechanism e and manual-feed tray b are arranged even further to the side than this flipping transport path f, because the space required for installation of the apparatus will increase by an amount corresponding thereto, it has not been possible to take full advantage of the reduction in installation space that would otherwise be afforded by the aforementioned layout (i.e., layouts having the intention of avoiding situations in which the discharge tray protrudes from the side of the apparatus). At this FIG. 15 as well, the amount of space that would be required for installation were it not for manual-feed tray b and paper pickup mechanism e is indicated by I, and the amount of space required for installation of the apparatus due to the fact that manual-feed tray b and paper pickup mechanism e are present is indicated by II.

Furthermore, the paper supply path in heretofore-developed image forming apparatuses has been such that the transport path for recording paper supplied from the automatic-feed cassette and the transport path for recording paper supplied from the manual-feed tray have intersected at a location immediately upstream from the image forming unit, and the overall paper supply path of the image forming apparatus has been quite long, increasing by a corresponding amount the complexity of the internal constitution within the apparatus main body as well as the number of locations at which paper jams can occur, and making reduction in the frequency of occurrence of paper jams difficult.

The present invention was conceived in light of such issues, it being an object thereof to provide a hybrid paper supply module permitting reduction in the amount of space required for image forming apparatus installation as well as reduction in the frequency of occurrence of paper jams, and an image forming apparatus equipped with such hybrid paper supply module(s).

SUMMARY OF INVENTION

Solution means employed by one or more embodiments of the present invention for achieving the foregoing and/or other object(s), even where hybrid paper supply modules are stacked together and each of a plurality of such hybrid paper supply modules comprises automatic-feed cassette mechanism unit(s) and manual-feed mechanism unit(s) present together in a single module, permits passage of recording medium or media between or among respective modules and permits such recording medium or media to be supplied to image forming unit(s) of image forming apparatus(es). That is, each hybrid paper supply module may be provided with slew passageway(s) affording passage in slewed fashion by way of such module. More specifically, one or more embodiments of the present invention may be predicated upon a hybrid paper supply module comprising one or more automatic-feed cassette mechanism units capable of containing one or more recording media for image formation to be carried out at one or more image forming units of one or more image forming apparatuses; and one or more manual-feed mechanism units permitting placement therein or thereon of one or more recording media by one or more users; wherein at least one of the automatic-feed cassette mechanism unit or units and at least one of the manual-feed mechanism unit or units constitute a single module. Even when such a hybrid paper supply module is stacked together with one or more other hybrid paper supply modules to form one or more multimodule sets, one or more recording medium transport paths passing through at least one interior of at least a portion of the hybrid paper supply modules may be formed so as to permit transport of one or more recording media toward at least one of the image forming unit or units of at least one of the image forming apparatus or apparatuses regardless of from which of the hybrid paper supply modules the one or more recording media is or are taken up.

As a result of such specific features, where a plurality of the foregoing hybrid paper supply modules are stacked together to form multimodule set(s), when recording medium or media is/are taken up from hybrid paper supply module(s) other than topmost-stacked hybrid paper supply module(s) (i.e., hybrid paper supply module(s) other than hybrid paper supply module(s) located furthest downstream in recording medium transport direction(s)), such recording medium or media pass through (travel in slewed fashion by way of) recording medium transport path(s) at interior(s) of hybrid paper supply module(s) located downstream therefrom (i.e., stacked therebelow) and is/are supplied to image forming unit(s) of image forming apparatus(es). Furthermore, prescribed image processing is carried out at such image forming unit(s). It is accordingly possible to combine hybrid paper supply modules (each of a plurality of which might be such that automatic-feed cassette mechanism unit(s) and manual-feed mechanism unit(s) are arranged in substantially the same plane, with common paper transport path(s) being formed therebetween), making it possible to improve the degree to which such hybrid paper supply modules lend themselves to practical application.

The following may be presented as more specific example(s) of construction(s) which could be employed as path(s) for transporting recording medium or media. That is, a hybrid paper supply module according to one or more embodiments of the present invention may further comprise automatic-feed path(s) for transport of recording medium or media taken up from automatic-feed cassette mechanism unit(s) toward recording medium transport path(s); and manual-feed path(s) for transport of recording medium or media taken up from manual-feed mechanism unit(s) toward recording medium transport path(s); wherein recording medium transport path(s) is/are formed between automatic-feed cassette mechanism unit(s) and manual-feed mechanism unit(s).

As a result of such specific features, recording medium or media taken up from automatic-feed cassette mechanism unit(s) may be transported toward recording medium transport path(s) by way of automatic-feed path(s), and recording medium or media taken up from manual-feed mechanism unit(s) may be transported toward recording medium transport path(s) by way of manual-feed path(s). This makes it possible to achieve simplification of transport path(s) at interior(s) of automatic-feed cassette(s).

Furthermore, where this is the case, at least one location at which at least one of the automatic-feed path or paths communicates with at least one of the recording medium transport path or paths and at least one location at which at least one of the manual-feed path or paths communicates with at least one of the recording medium transport path or paths may be set so as to not be in mutual opposition. By so doing, it will be possible to avoid situations in which recording medium or media taken up from automatic-feed cassette mechanism unit(s) and traveling along automatic-feed path(s) inadvertently enters manual-feed path(s), and it will conversely be possible to avoid situations in which recording medium or media taken up from manual-feed mechanism unit(s) and traveling along manual-feed path(s) inadvertently enters automatic-feed path(s), making it possible to achieve improvement in reliability of recording medium transport operations.

Moreover, such a hybrid paper supply module may further comprise one or more paper takeup mechanisms and one or more paper separator mechanisms, respectively provided in at least one of the automatic-feed path or paths at one or more locations immediately upstream in at least one recording medium transport direction, permitting takeup of only a single recording medium sheet from at least one of the automatic-feed cassette mechanism unit or units; and one or more paper takeup mechanisms and one or more paper separator mechanisms, respectively provided in at least one of the manual-feed path or paths at one or more locations immediately upstream in at least one recording medium transport direction, permitting takeup of only a single recording medium sheet from at least one of the manual-feed mechanism unit or units. In accordance herewith, when recording medium or media is/are to be taken up from automatic-feed cassette mechanism unit(s), paper takeup mechanism(s) (e.g., takeup roller(s)) and paper separator mechanism(s) (comprising, e.g., separator roller(s) and separator plate(s)) provided at the automatic-feed cassette mechanism unit(s) might be driven such that only one recording medium sheet is taken up from the automatic-feed cassette mechanism unit(s). Similarly, when recording medium or media is/are to be taken up from manual-feed mechanism unit(s), paper takeup mechanism(s) and paper separator mechanism(s) provided at the manual-feed mechanism unit(s) might be driven such that only one recording medium sheet is taken up from the manual-feed mechanism unit(s). By thus providing each of the respective feed mechanism units with its own dedicated mechanism for takeup of recording media, it is possible to cause recording media takeup operations at respective mechanism units to take place in rapid and stable fashion.

Furthermore, the following constitution(s) may be adopted for ensuring good transport characteristics for recording medium or media at interior(s) of respective hybrid paper supply module(s). That is, such a hybrid paper supply module may further comprise at the interior thereof one or more transport rollers for transporting, toward at least one of the other hybrid paper supply module or modules located downstream in at least one recording medium transport direction and/or at least one of the image forming unit or units of at least one of the image forming apparatus or apparatuses, one or more recording media transported to at least one of the recording medium transport path or paths from at least one of the other hybrid paper supply module or modules. In such case, as transport roller(s), new roller(s) (i.e., roller(s) functioning only to transport recording medium or media along recording medium transport path(s)) provided at recording medium transport path(s) may be employed; and/or roller(s) installed at outlet side(s) of recording medium transport path(s) for the purpose of functioning as registration roller(s) should the hybrid paper supply module be employed as topmost-stacked hybrid paper supply module may also be made to serve as same (i.e., such roller(s) may function to transport recording medium or media along recording medium transport path(s) and also function as registration roller(s)).

The following may be presented as exemplary constitutions of paper guides for respective mechanism units when a plurality of hybrid paper supply modules are stacked together as described above. That is, paper guide(s) of fixed type such as will exclusively accept one specific recording medium size may be provided at automatic-feed cassette mechanism unit(s). Furthermore, paper guide(s) of movable type such as will permit placement therein or thereon of multiple sizes of recording media may be provided at manual-feed mechanism unit(s). By so doing, it will be possible when carrying out manual paper feed for user(s) to utilize any arbitrary manual-feed mechanism unit(s) in carrying out paper feed operations. If, for example, topmost-stacked hybrid paper supply module(s) lend itself or themselves to convenient usage, this would permit such hybrid paper supply module(s) to be used regardless of recording medium size(s). Or where recording medium or media of different size(s) had already been placed in or on such topmost-stacked hybrid paper supply module(s), this would permit other hybrid paper supply module(s) to be used.

Moreover, also within the purview of the technical idea of the present invention are image forming apparatus(es) equipped with hybrid paper supply module(s) in accordance with any one among the foregoing respective solution means. That is, such an image forming apparatus might have a paper supply system formed by stacking together a plurality of paper supply modules; wherein image formation is carried out on one or more recording media taken up from at least one of the automatic-feed cassette mechanism unit or units or at least one of the manual-feed mechanism unit or units of any one of the paper supply modules and supplied to at least one of the image forming unit or units by way of at least one of the recording medium transport path or paths at the interior(s) of at least a portion of the hybrid paper supply modules.

Incorporating manual-feed mechanism unit(s) and automatic-feed cassette mechanism unit(s) into a single integral structure as described above makes it possible, in one or more embodiment(s) of the present invention, for manual-feed mechanism unit(s) to be arranged so as to be stacked vertically with respect to transport path(s) extending so as to be directed toward image forming unit(s) of image forming apparatus(es), as a result of which it is possible to shorten dimension(s) of image forming apparatus(es) and achieve reduction in the amount of space required for installation.

Furthermore, such hybrid paper supply module(s) make it possible to cause path(s) along which recording medium or media taken up from automatic-feed cassette mechanism unit(s) is/are transported and path(s) along which recording medium or media taken up from manual-feed mechanism unit(s) is/are transported to intersect at interior(s) of module(s), and makes it possible to decrease length(s) of respective path(s). This being the case, the length of the overall paper transport path of the apparatus can be shortened, the number of locations at which paper jams can occur can be reduced, and image forming operations at the apparatus can be carried out in stable fashion.

Furthermore, even where hybrid paper supply modules are stacked together and each of a plurality of such hybrid paper supply modules comprises automatic-feed cassette mechanism unit(s) and manual-feed mechanism unit(s) present together in a single module, recording medium transport path(s) may be provided at module interior(s) so as to permit passage of recording medium or media through respective module(s) and permit such recording medium or media to be supplied to image forming unit(s) of image forming apparatus(es). This being so, even in the case of hybrid paper supply modules (each of which might be such that automatic-feed cassette mechanism unit(s) and manual-feed mechanism unit(s) are arranged in substantially the same plane, with common paper transport path(s) being formed therebetween) it will be possible to combine a plurality of modules, making it possible to improve the degree to which such hybrid paper supply modules lend themselves to practical application.

Furthermore, solution means employed by one or more embodiments of the present invention for achieving the foregoing and/or other object(s), in the context of a paper supply mechanism formed by stacking together hybrid paper supply modules, each of a plurality of which has automatic-feed cassette mechanism unit(s) and manual-feed mechanism unit(s) constituting a single module, may be such that, in correspondence to image forming condition(s) during image formation, e.g., size(s) of paper on which image formation is to be carried out, manual-feed tray(s) capable of accepting placement therein or thereon of paper of such size(s) might, for example, be actuated in automatic fashion so as to go from stored state(s) (state(s) not permitting usage thereof) to deployed state(s) (state(s) permitting usage thereof), as a result of which user(s) could be informed of which manual-feed mechanism unit(s) it is or are that should be used. More specifically, one or more embodiments of the present invention may be predicated upon a paper supply mechanism comprising a plurality of hybrid paper supply modules having one or more automatic-feed cassette mechanism units capable of containing one or more recording media for image formation to be carried out at one or more image forming units of one or more image forming apparatuses; and one or more manual-feed mechanism units permitting placement therein or thereon of one or more recording media by one or more users; at least one of the automatic-feed cassette mechanism unit or units and at least one of the manual-feed mechanism unit or units constituting a single module. This paper supply mechanism might be such that at least one of the manual-feed mechanism unit or units of each of a plurality of the hybrid paper supply modules is respectively equipped with at least one manual-feed tray capable of being stored when not in use and capable of being deployed so as to permit placement therein or thereon of one or more recording media by one or more users when in use. Furthermore, one or more automatic deployment means may be provided permitting at least one of the manual-feed trays to be actuated in automatic fashion so as to go from at least one stored state to at least one deployed state. Moreover, the constitution may be such that at least one of the automatic deployment means causes one of the respective manual-feed trays to be actuated in automatic fashion so as to go from at least one stored state to at least one deployed state in correspondence to at least one image forming condition during at least one image forming operation.

In such case, at least one size of at least one recording medium capable of being placed in or on at least one manual-feed mechanism unit may be substantially the same as at least one size of at least one recording medium capable of being contained within at least one automatic-feed cassette mechanism unit at each of a plurality of the respective hybrid paper supply modules.

As a result of such specific features, when image forming operation(s) is/are carried out with paper being supplied in manual-feed fashion, it is possible to cause only manual-feed tray(s) capable of accepting placement therein or thereon of paper of size(s) set at image forming condition(s) to be actuated in automatic fashion so as to go from stored state(s) to deployed state(s). By noticing such manual-feed tray deployment operation(s), it would be possible for user(s) to easily identify which manual-feed mechanism unit(s) it is or are that should be used. This being the case, even where manual-feed mechanism unit(s) at each individual hybrid paper supply module has or have been made capable of accommodating a single, fixed paper size in order to achieve simplified apparatus constitution, user(s) need not know in advance which hybrid paper supply module(s) has or have manual-feed mechanism unit(s) corresponding to which paper size(s), but need only place recording medium or media in or on manual-feed tray(s) that has or have undergone the foregoing deployment operation(s). This being the case, it is possible to simplify manual-feed mechanism unit selection operation(s), and it is possible to improve image forming apparatus user-friendliness.

Furthermore, the following may be presented as specific example(s) of construction(s) which could be employed for causing at least one size of at least one recording medium capable of being placed in or on at least one manual-feed mechanism unit to be substantially the same as at least one size of at least one recording medium capable of being contained within at least one automatic-feed cassette mechanism unit at each of a plurality of the respective hybrid paper supply modules. That is, attached to at least one of the manual-feed trays there may be one or more guide members constraining one or more placement locations of one or more recording media placed therein or thereon by abutting against one or more side edges extending in one or more transport directions of at least one of the recording medium or media. Furthermore, at least one location at which at least one of the guide member or members is attached thereto may be set so as to be at least one location constraining at least one placement location of at least one recording medium of substantially identical size as at least one recording medium capable of being contained within at least one automatic-feed cassette mechanism unit at the same hybrid paper supply module.

Furthermore, each of the manual-feed trays may respectively be equipped with one or more auxiliary trays capable of extending total tray length when deployed. Moreover, at least one of the auxiliary tray or trays with which each of the manual-feed trays is equipped may be of such size and shape as to, when extended, permit placement therein or thereon of at least one recording medium of substantially identical size as at least one recording medium capable of being contained within at least one automatic-feed cassette mechanism unit at the same hybrid paper supply module.

Furthermore, as a specific example of a construction which could be employed as automatic deployment means, at least one of the automatic deployment means may be provided with at least one electromagnet that, when electricity flows therethrough, becomes energized, causing at least one of the manual-feed trays to be electromagnetically attracted thereto and assume at least one stored state; and that, when electricity does not flow therethrough, becomes deenergized, terminating said electromagnetic attraction and causing at least one of the manual-feed trays to assume at least one deployed state. That is, electromagnet(s) of only manual-feed tray(s) capable of accepting placement therein or thereon of paper of size(s) set at image forming condition(s) might be deenergized, terminating such electromagnetic attraction and causing manual-feed tray(s) to be actuated in automatic fashion so as to go from stored state(s) to deployed state(s).

The following may be presented as a specific example of paper feed operations of which the paper supply mechanism might be capable. That is, in the event that at least one of the manual-feed trays becomes depleted of recording media during the course of at least one image forming operation when one or more recording media placed in or on at least one of the manual-feed tray or trays of at least one of the manual-feed mechanism unit or units is or are supplied to at least one of the image forming unit or units and at least one image forming operation is being carried out, one or more recording media contained within at least one of the automatic-feed cassette mechanism unit or units at the same hybrid paper supply module might be supplied to at least one of the image forming unit or units and at least one image forming operation is carried out.

This being the case, even where insufficient number(s) of sheets of recording medium or media has or have been placed in or on manual-feed tray(s), it would be possible to use recording medium or media contained within automatic-feed cassette mechanism unit(s) at the same hybrid paper supply module(s) to complete image formation, and it would be possible to avoid situations in which image forming operation(s) terminate despite the fact that image forming operation(s) have not yet been completed.

Furthermore, in the event that at least one of the image forming apparatus or apparatuses enters at least one standby state after one or more recording media placed in or on at least one of the manual-feed tray or trays of at least one of the manual-feed mechanism unit or units has or have been supplied to at least one of the image forming unit or units and at least one image forming operation carried out thereon has terminated, one or more alerts might be issued prompting one or more users to remove one or more recording media remaining in or on at least one of the manual-feed tray or trays of at least one of the manual-feed mechanism unit or units and to put at least one of the manual-feed trays in at least one stored state.

This would make it possible to prevent manual-feed tray(s) already in deployed state(s) (manual-feed tray(s) not being used) from being present when attempt(s) is/are made to initiate subsequent image forming operation(s), and would make it possible to cause only manual-feed tray(s) corresponding to image forming condition(s) during such image forming operation(s) to assume deployed state(s) as a result of operation(s) performed by automatic deployment means.

Moreover, also within the purview of the technical idea of the present invention are image forming apparatus(es) equipped with paper supply mechanism(s) in accordance with any one among the foregoing respective solution means. That is, in such an image forming apparatus, image formation would be carried out on one or more recording media supplied to at least one of the image forming unit or units after being taken up from at least one of the automatic-feed cassette mechanism unit or units or at least one of the manual-feed mechanism unit or units of at least one of the hybrid paper supply modules.

Because automatic-feed cassette mechanism unit(s) and manual-feed mechanism unit(s) may be incorporated into a single integral hybrid paper supply module as described above, it is possible in one or more embodiment(s) of the present invention for manual-feed mechanism unit(s) to be arranged so as to be stacked vertically with respect to flipping transport path(s) and main transport path(s) extending so as to be directed toward printing unit(s) of hybrid device(s), as a result of which it is possible to shorten dimension(s) of hybrid device(s) and achieve reduction in the amount of space required for installation.

Furthermore, such hybrid paper supply module(s) make it possible to cause path(s) along which recording medium or media taken up from automatic-feed cassette mechanism unit(s) is/are transported and path(s) along which recording medium or media taken up from manual-feed mechanism unit(s) is/are transported to intersect at interior(s) of module(s), and makes it possible to decrease length(s) of respective path(s). This being the case, the length of the overall paper transport path of the apparatus can be shortened, the number of locations at which paper jams can occur can be reduced, and image forming operations at the apparatus can be carried out in stable fashion.

Furthermore, one or more embodiments of the present invention may be such that in the context of a paper supply mechanism formed by stacking together hybrid paper supply modules, each of a plurality of which has automatic-feed cassette mechanism unit(s) and manual-feed mechanism unit(s) constituting a single module, in correspondence to image forming condition(s) during image formation, manual-feed tray(s) capable of accepting placement therein or thereon of recording medium or media of such size(s) might be actuated in automatic fashion so as to go from stored state(s) to deployed state(s), as a result of which user(s) could be informed of which manual-feed mechanism unit(s) it is or are that should be used. This being the case, even where manual-feed mechanism unit(s) at each individual hybrid paper supply module has or have been made capable of accommodating a single, fixed paper size in order to achieve simplified apparatus constitution, user(s) need not know in advance which hybrid paper supply module(s) has or have manual-feed mechanism unit(s) corresponding to which paper size(s), but need only place recording medium or media in or on manual-feed tray(s) that has or have undergone the foregoing deployment operation(s). This being the case, it is possible to simplify manual-feed mechanism unit selection operation(s), and it is possible to improve image forming apparatus user-friendliness.

That is, one or more embodiments of the present invention may be such that in correspondence to image forming condition(s), electromagnet(s) is/are turned OFF, causing such specific manual-feed tray(s) to be opened (deployed). This being the case, it is possible for user(s) to easily identify which manual-feed mechanism unit(s) it is or are that should be used by noticing such manual-feed tray deployment operation(s), it is possible to simplify manual-feed mechanism unit selection operation(s), and it is possible to improve image forming apparatus user-friendliness.

DESCRIPTION OF PREFERRED EMBODIMENTS

First Embodiment

The following embodiment of the present invention is described with reference to the drawings. At the present embodiment, description is carried out in terms of an example in which the present invention is applied to a hybrid device equipped with copier function, printer function, and facsimile function.

—Description of Overall Constitution of Hybrid Device—

Figure 1:
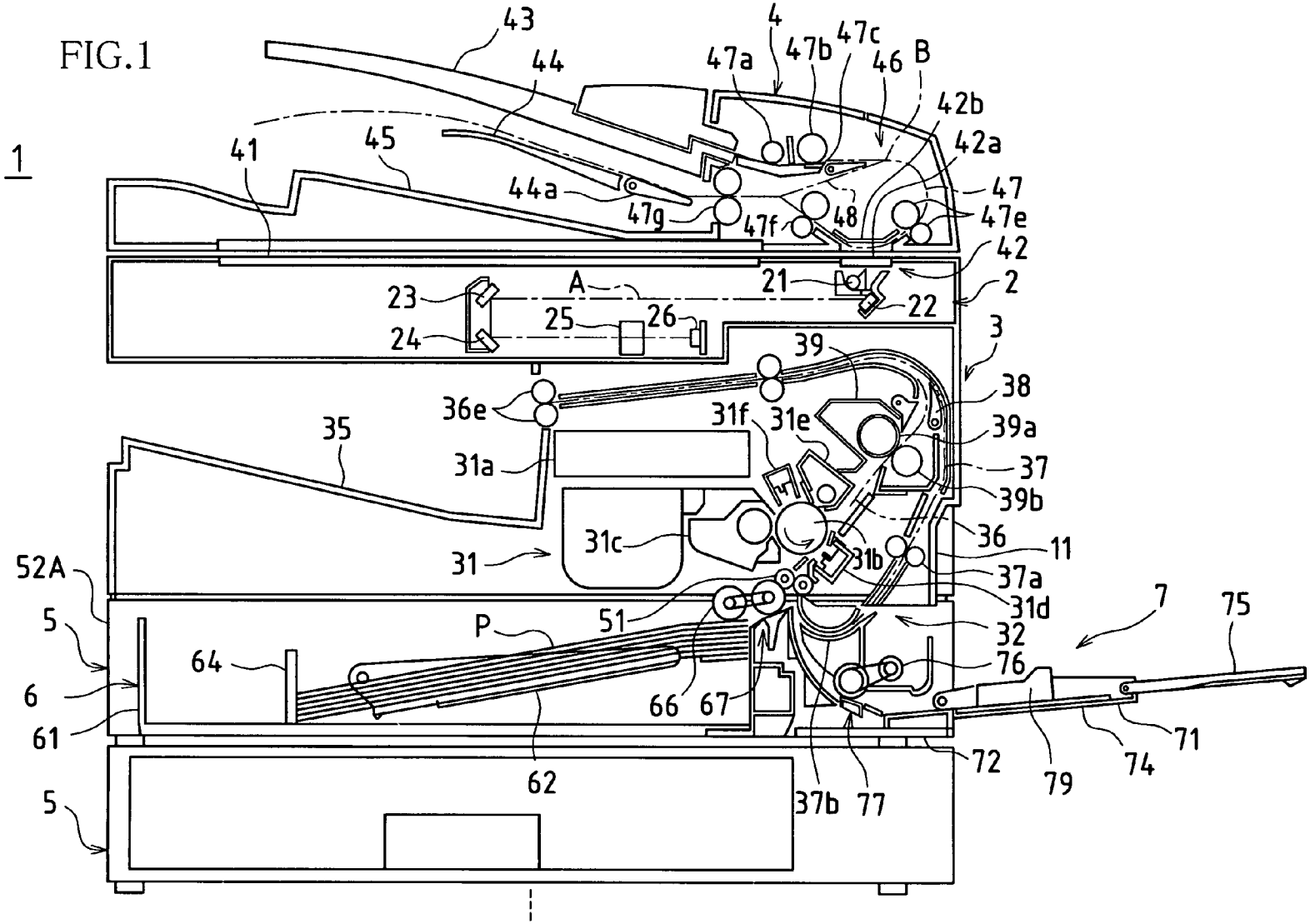
FIG. 1 is a drawing showing in schematic fashion the internal constitution of a hybrid device associated with an embodiment of the present invention.
Figure 2:
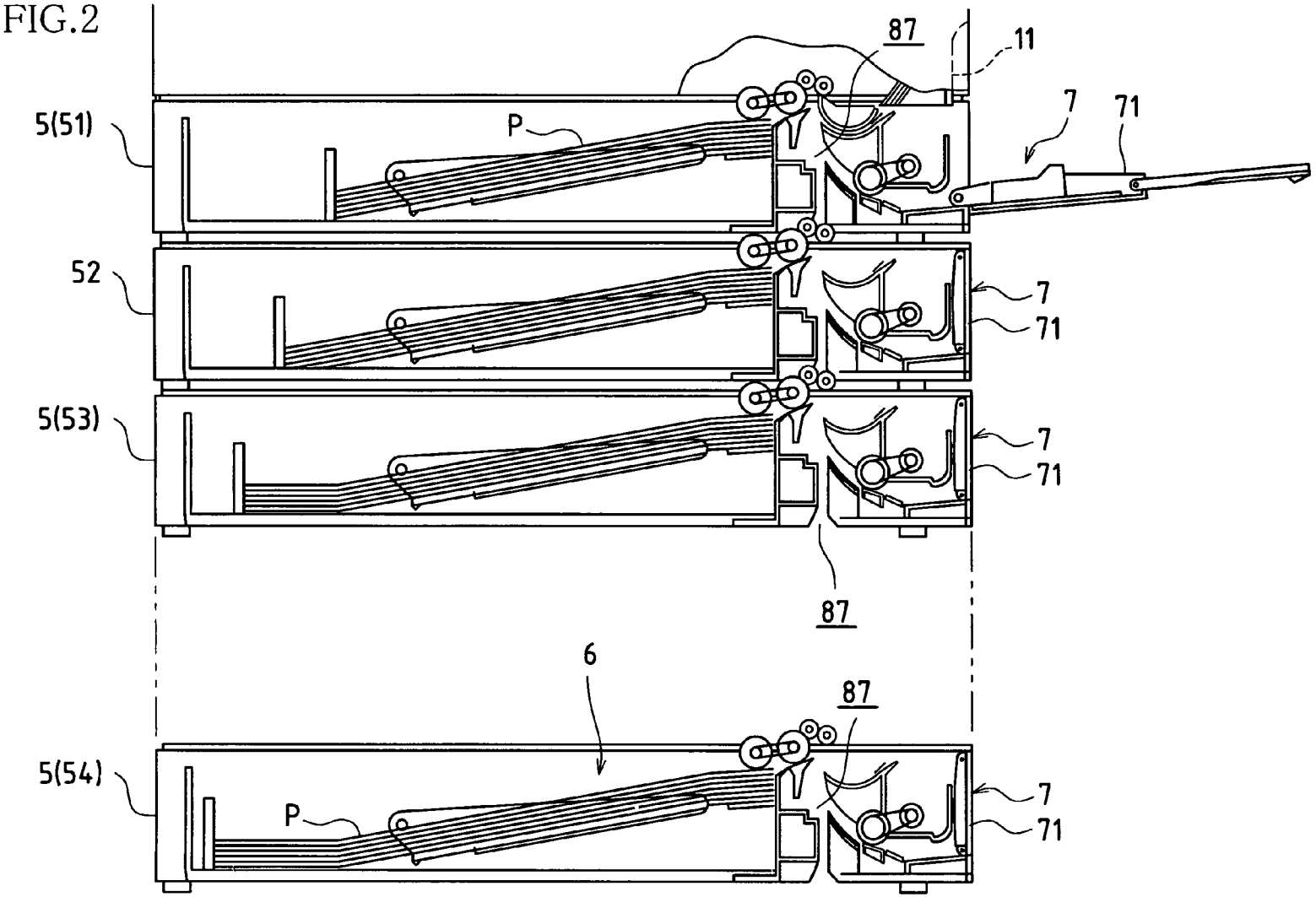
FIG. 2 is a drawing showing in schematic fashion the respective constitutions at the interiors of a plurality of hybrid paper supply modules that have been stacked together.

FIG. 1 shows in schematic fashion the internal constitution of hybrid device 1 which serves as image forming apparatus associated with the present embodiment. Furthermore, FIG. 2 shows in schematic fashion the respective constitutions at the interiors of a plurality of hybrid paper supply modules 5, 5, . . . that have been stacked together, same being characteristic of one or more embodiments of the present invention. As shown in FIG. 1, hybrid device 1 is provided with scanning unit 2, printing unit 3 serving as image forming unit, and automatic original feed unit 4. Description of the respective units follows below.

Description of Scanning Unit 2

At the subassembly represented by scanning unit 2, images of originals placed on original stage 41 comprising transparent glass or the like and/or images of originals fed one at a time from automatic original feed unit 4 are captured and image data is created. This scanning unit 2 is provided with exposing light source 21; plurality of reflecting mirrors 22, 23, 24; imaging lens 25; and photoelectric conversion element (CCD=charge coupled device) 26.

The aforementioned exposing light source 21 causes light to be irradiated onto originals placed on original stage 41 of automatic original feed unit 4 and/or originals transported thereto by automatic original feed unit 4. As indicated by the optical axis depicted using alternating long and short chain line A at FIG. 1, respective reflecting mirrors 22, 23, 24 cause light reflected from the original to first be reflected to the left as viewed in the drawing, to thereafter be reflected downward, and to thereafter be reflected to the right as viewed in the drawing so as to be directed toward imaging lens 25.

Operations for capturing an original image are such that, in the situation where the original is placed on the aforementioned original stage 41 (i.e., during stationary sheet operation), exposing light source 21 and respective reflecting mirrors 22, 23, 24 scan horizontally in parallel fashion with respect to original stage 41 so as to capture an image of the entire original. On the other hand, in the situation where the original is transported by automatic original feed unit 4 (i.e., during moving sheet operation), exposing light source 21 and respective reflecting mirrors 22, 23, 24 remain stationary at the position indicated at FIG. 1, and original capturing unit 42 of automatic original feed unit 4, described below, is made to capture an image of the original when the original passes therethrough.

Light reflected by the aforementioned respective reflecting mirrors 22, 23, 24 and passing through imaging lens 25 is guided to photoelectric conversion element 26, the reflected light being converted into electrical signal(s) (original image data) at this photoelectric conversion element 26.

Description of Printing Unit 3

Printing unit 3 is provided with image forming system 31 and paper transport system 32.

Image forming system 31 is provided with laser scanning unit 31*a* and photosensitive drum 31*b* serving as drum-type image carrier. Laser scanning unit 31*a* irradiates the surface of photosensitive drum 31*b* with laser light based on original image data produced by conversion at the aforementioned photoelectric conversion element 26. Photosensitive drum 31*b* rotates in the direction indicated by the arrow in FIG. 1, and a latent electrostatic image is formed on the surface thereof as a result of irradiation thereof by laser light from laser scanning unit 31*a*.

Furthermore, at the outside periphery of photosensitive drum 31*b*, there are arranged in order circumferentially thereabout—in addition to the aforementioned laser scanning unit 31*a*—developer apparatus (developer mechanism) 31*c*, transfer unit 31*d* constituting a transfer mechanism, cleaning apparatus (cleaning mechanism) 31*e*, a charge-removing unit (not shown), and charging unit 31*f* Developer apparatus 31*c* uses toner (i.e., a substance for making the latent image manifest) to develop the latent electrostatic image formed on the surface of photosensitive drum 31*b* and produce a visible image. Transfer unit 31*d* transfers the toner image formed on the surface of photosensitive drum 31*b* onto recording paper P, which serves as recording medium. Cleaning apparatus 31*e* removes toner residue from the surface of photosensitive drum 31*b* following toner transfer. The charge-removing unit removes any charge remaining on the surface of photosensitive drum 31*b*. Charging unit 31*f* charges the surface of photosensitive drum 31*b* to a prescribed electric potential prior to formation of the latent electrostatic image.

When forming an image on recording paper P, therefore, charging unit 31*f* causes the surface of photosensitive drum 31*b* to be charged to a prescribed electric potential, and laser scanning unit 31*a* irradiates the surface of photosensitive drum 31*b* with laser light based on original image data. Developer apparatus 31*c* then develops a visible toner image on the surface of photosensitive drum 31*b*, and transfer unit 31*d* causes the toner image to be transferred to recording paper P. In addition, cleaning apparatus 3 le then removes toner residue from the surface of photosensitive drum 31*b*, and the charge-removing unit removes any charge remaining on the surface of photosensitive drum 31*b*. This concludes one cycle of image forming operations (printing operations) carried out on recording paper P. By repeating this cycle, it is possible to continuously carry out image formation on a plurality of sheets of recording paper P.

Furthermore, paper transport system 32 transports recording paper P one sheet at a time from either automatic-feed cassette mechanism unit 6 or manual-feed mechanism unit 7 provided at each of a plurality of hybrid paper supply modules 5, 5, . . . , described below, so as to permit image formation by the aforementioned image forming system 31, and also discharges recording paper P to discharge tray 35 serving as paper discharge unit after image(s) have been formed thereon.

This paper transport system 32 is provided with main transport path 36 and flipping transport path 37. One end of main transport path 36 opposes the discharge side of topmost-stacked hybrid paper supply module 5, and the other end thereof opposes discharge tray 35. One end of flipping transport path 37 is connected to main transport path 36 at a point upstream from (below, in the drawing) the location at which transfer unit 31*d* is installed, and the other end thereof is connected to main transport path 36 at a point downstream from (above, in the drawing) the location at which transfer unit 31*d* is installed. Moreover, in the present embodiment, a portion of flipping transport path 37 passes through the interior of topmost-stacked hybrid paper supply module 5. For this reason, guide member 37*b*, for forming flipping transport path 37, is provided at the interior of hybrid paper supply module 5.

In addition, it is possible to cause recording paper P to be fed in intermittent fashion, one sheet at a time, toward printing unit 3 from either mechanism unit 6, 7 in accompaniment to driving of the aforementioned automatic-feed cassette mechanism unit 6 or manual-feed mechanism unit 7.

Registration roller(s) 51, provided at hybrid paper supply module 5, is/are arranged at a point upstream from the location at which transfer unit 31*d* is installed in the aforementioned main transport path 36. These registration rollers 51 transport recording paper P while aligning recording paper P with the toner image on the surface of photosensitive drum 31*b*. Installed at a point downstream from the location at which transfer unit 31*d* is installed in this main transport path 36 is fuser apparatus 39, which is provided with a pair of fuser rollers 39*a*, 39*b*. Moreover, installed at the downstream end of main transport path 36 is/are discharge roller(s) 36*e* for discharging recording paper P into discharge tray 35.

Arranged at a location at the top end of flipping transport path 37, where flipping transport path 37 joins main transport path 36, is diverter paddle 38. This diverter paddle 38 is capable of being rotated about a horizontal axis between a first position indicated by the solid line in FIG. 1 and a second position which is arrived at as a result of counterclockwise rotation as viewed in the drawing from the first position and which causes access to be opened up to flipping transport path 37. When this diverter paddle 38 is in its first position, recording paper P is transported toward discharge tray 35; and when it is in its second position, it permits recording paper P to be supplied to flipping transport path 37. Transport roller(s) 37*a* is/are arranged in flipping transport path 37; and when recording paper P is supplied to flipping transport path 37 (i.e., when recording paper P is supplied to flipping transport path 37 pursuant to "switchback transport"), recording paper P is transported by these transport rollers 37*a*, recording paper P being flipped at a location upstream of registration rollers 51, and being again transported along main transport path 36 toward transfer unit 31*d*. That is, arrangements are made to permit image formation to be carried out on the back of recording paper P.

Description of Automatic Original Feed Unit 4

Automatic original feed unit 4 will next be described. This automatic original feed unit 4 is constructed so as to permit it to serve as "automatic double-sided original transport apparatus." This automatic original feed unit 4 is capable of being used for moving sheet operation, and is provided with original loading unit(s) comprising original tray 43 and intermediate tray 44 and original discharge tray 45 serving as original discharge unit, and original transport system 46 for transporting originals between respective trays 43, 44, 45.

The aforementioned original transport system 46 is provided with main transport path 47 for transporting original(s) placed in or on original tray 43 to intermediate tray 44 and/or original discharge tray 45 by way of original capturing unit 42; and auxiliary transport path 48 for supplying original(s) to main transport path 47 from intermediate tray 44.

Arranged at the upstream end of main transport path 47 (at a region opposing the discharge side of original tray 43) are original takeup roller(s) 47*a* and separator roller(s) 47*b*. Arranged below separator roller(s) 47*b* is/are separator plate(s) 47*c*, and in accompaniment to rotation of takeup roller 47*a*, one sheet from among the original(s) in original tray 43 is made to pass between this separator roller 47*b* and this separator plate 47*c*, and is supplied to main transport path 47. Arranged at a location downstream of the intersection (region B in the drawing) of main transport path 47 and auxiliary transport path 48 are PS rollers 47*e*, 47*e*. These PS rollers 47*e*, 47*e* supply originals to original capturing unit 42 such that the leading edge of the original is coordinated with the timing with which image capture occurs at scanning unit 2. That is, upon supply of an original thereto, these PS rollers 47*e*, 47*e* temporarily stop transport of the original so as to permit adjustment of the aforementioned timing before supplying the original to original capturing unit 42.

Original capturing unit 42 is provided with glass platen 42*a* and original backpressure plate 42*b*, and when an original supplied thereto by PS rollers 47*e*, 47*e* passes between glass platen 42*a* and original backpressure plate 42*b*, light from the aforementioned exposing light source 21 passes through glass platen 42*a* and irradiates the original. At this time, acquisition of original image data by the aforementioned scanning unit 2 occurs. A restoring force from a coil spring, not shown, is imparted to the back (top) of the aforementioned original backpressure plate 42*b*. This causes original backpressure plate 42*b* to press against and contact glass platen 42*a* with a prescribed force so as to discourage the original from lifting up off of glass platen 42*a* as the original passes through original capturing unit 42.

Provided downstream from glass platen 42*a* are transport rollers 47*f* and original discharge rollers 47*g*. The constitution is such that upon passing over glass platen 42*a*, original(s) is/are discharged to intermediate tray 44 and/or original discharge tray 45 by way of transport rollers 47*f* and original discharge rollers 47*g*.

Arranged between original discharge rollers 47*g* and intermediate tray 44 is intermediate tray pivot plate 44*a*. The pivoting motion of this intermediate tray pivot plate 44*a* being centered on the end thereof which is nearer to intermediate tray 44, intermediate tray pivot plate 44*a* is capable of pivoting between a first position indicated by the solid line in the drawing and a second position arrived at when swung upward from the first position. When intermediate tray pivot plate 44*a* is in its second position, originals discharged by original discharge rollers 47*g* are recovered into original discharge tray 45. On the other hand, when intermediate tray pivot plate 44*a* is in its first position, originals discharged by original discharge rollers 47*g* are discharged into intermediate tray 44. When an original is discharged to this intermediate tray 44, the edge of the original is held in the nip between original discharge rollers 47*g*, 47*g*; and with the original in this state, original discharge rollers 47*g* then rotate in reverse fashion, causing the original to be supplied to auxiliary transport path 48, and after traveling through this auxiliary transport path 48, the original is again delivered to main transport path 47. Operations whereby these original discharge rollers 47*g* are made to rotate in reverse fashion are carried out such that delivery of the original to main transport path 47 is coordinated with the timing with which image capture occurs. This make it possible for original capturing unit 42 to capture an image of the back of the original.

—Description of Basic Operation of Hybrid Device—

Among the operations carried out by hybrid device 1 having the foregoing constitution, hybrid device 1—firstly when functioning as a printer—receives print data (image data and/or text data) sent thereto from a personal computer or other such host device, and temporarily stores this received print data in buffer(s) (memory or memories), not shown. Along with such storage of print data to buffer, print data is sequentially read from buffer; and based on the print data read therefrom, image formation is carried out on recording paper P by virtue of image forming operations taking place at the aforementioned printing unit 3.

Furthermore, when functioning as a scanner, hybrid device 1 temporarily stores, in buffer(s), scan image data of original(s) captured by the aforementioned scanning unit 2. Along with such storage of scan image data to buffer, scan image data is sequentially sent from buffer to host apparatus, image(s) thereof being displayed on a display or the like at this host apparatus. Note that when hybrid device 1 functions as a facsimile device, this scan image data would be sent to a regular public line.

Moreover, when functioning as a copier, hybrid device 1 temporarily stores, in buffer(s), image formation is carried out on recording paper P by virtue of image forming operations taking place at printing unit 3 based on original image data captured by means of the foregoing scanner function.

—Description of Hybrid Paper Supply Module 5—

The aforementioned hybrid paper supply module 5, being a characteristic feature of the present embodiment, will next be described. As shown in FIGS. 1 and 2, in the present hybrid device 1, a plurality of hybrid paper supply modules 5, 5, . . . are arranged so as to be stacked together. Because respective hybrid paper supply modules 5, 5, . . . are all of substantially identical constitution, description is here carried out in terms of one hybrid paper supply module 5 taken to be representative thereamong.

Figure 3:
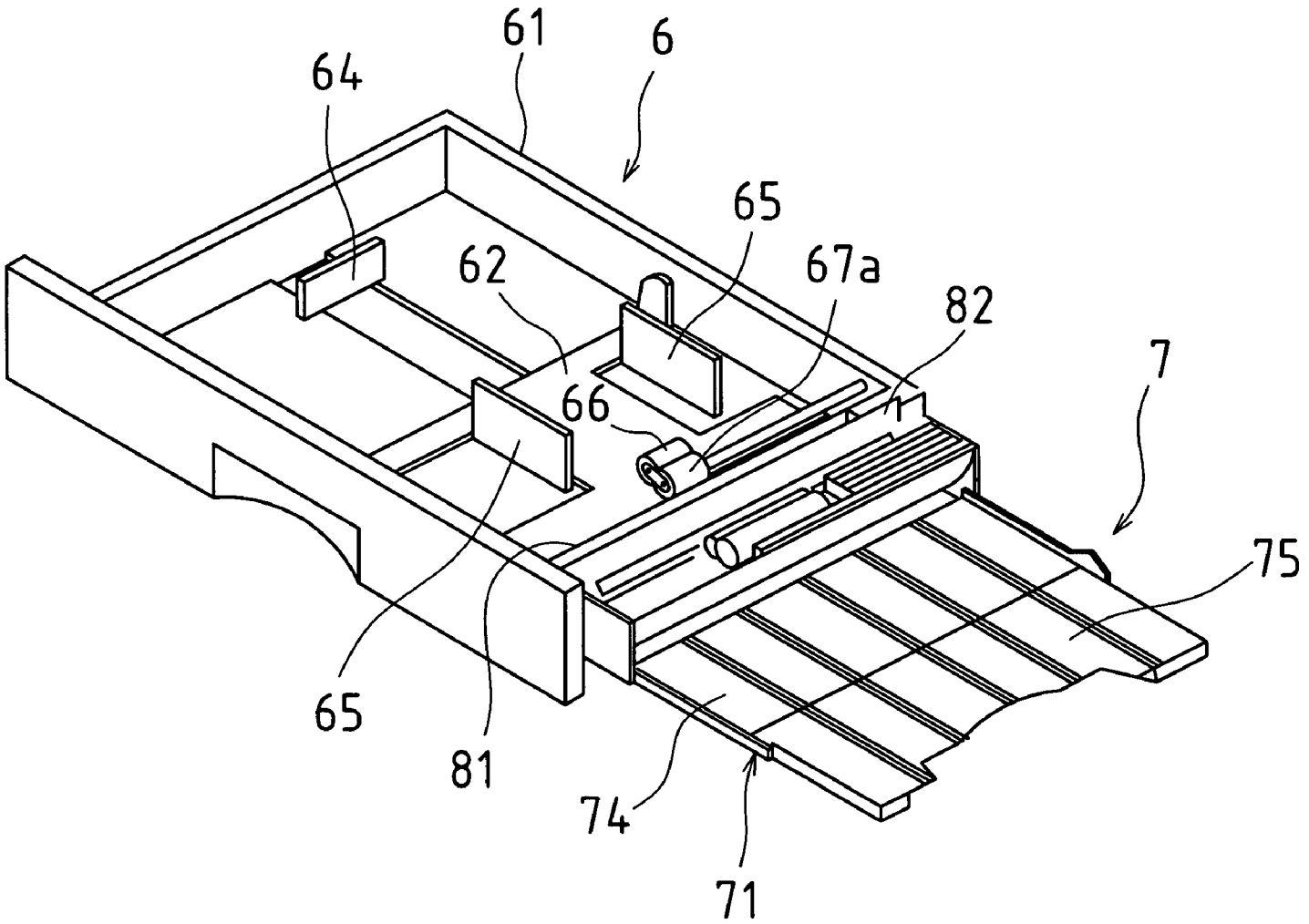
FIG. 3 is an oblique partial cutaway view of a hybrid paper supply module.

FIG. 3 is an oblique partial cutaway view of automatic-feed cassette mechanism unit 6 and manual-feed mechanism unit 7 of hybrid paper supply module 5. Furthermore, FIG. 4 is a drawing showing in schematic fashion a simplified rendering of the constitution at the interior of this hybrid paper supply module 5.

As shown in the respective drawings, hybrid paper supply module 5 is constructed such that the foregoing automatic-feed cassette mechanism unit 6 and manual-feed mechanism unit 7 are contained within module casing 52A, which constitutes the housing of the present module 5. Moreover, whereas automatic-feed cassette mechanism unit 6 is provided with automatic-feed cassette 61 which is capable of storing a multiplicity of sheets (e.g., 500 sheets) of recording paper P, manual-feed mechanism unit 7 is provided with manual-feed tray 71 which is such as to permit one or a small number of sheets of recording paper to be placed therein or thereon in a manual operation carried out by the user. In other words, this automatic-feed cassette 61 and this manual-feed tray 71 are contained within module casing 52A, forming a single module and constituting the present hybrid paper supply module 5. Moreover, the aforementioned module casing 52A is constructed in the shape of a box having base section 52*c*, top section 52*d*, and side sections 52*e* provided at the three sides which do not include the side at which the foregoing manual-feed mechanism unit 7 is installed. Description of the respective mechanism units 6, 7 follows below.

Description of Automatic-Feed Cassette Mechanism Unit 6

Figure 4:
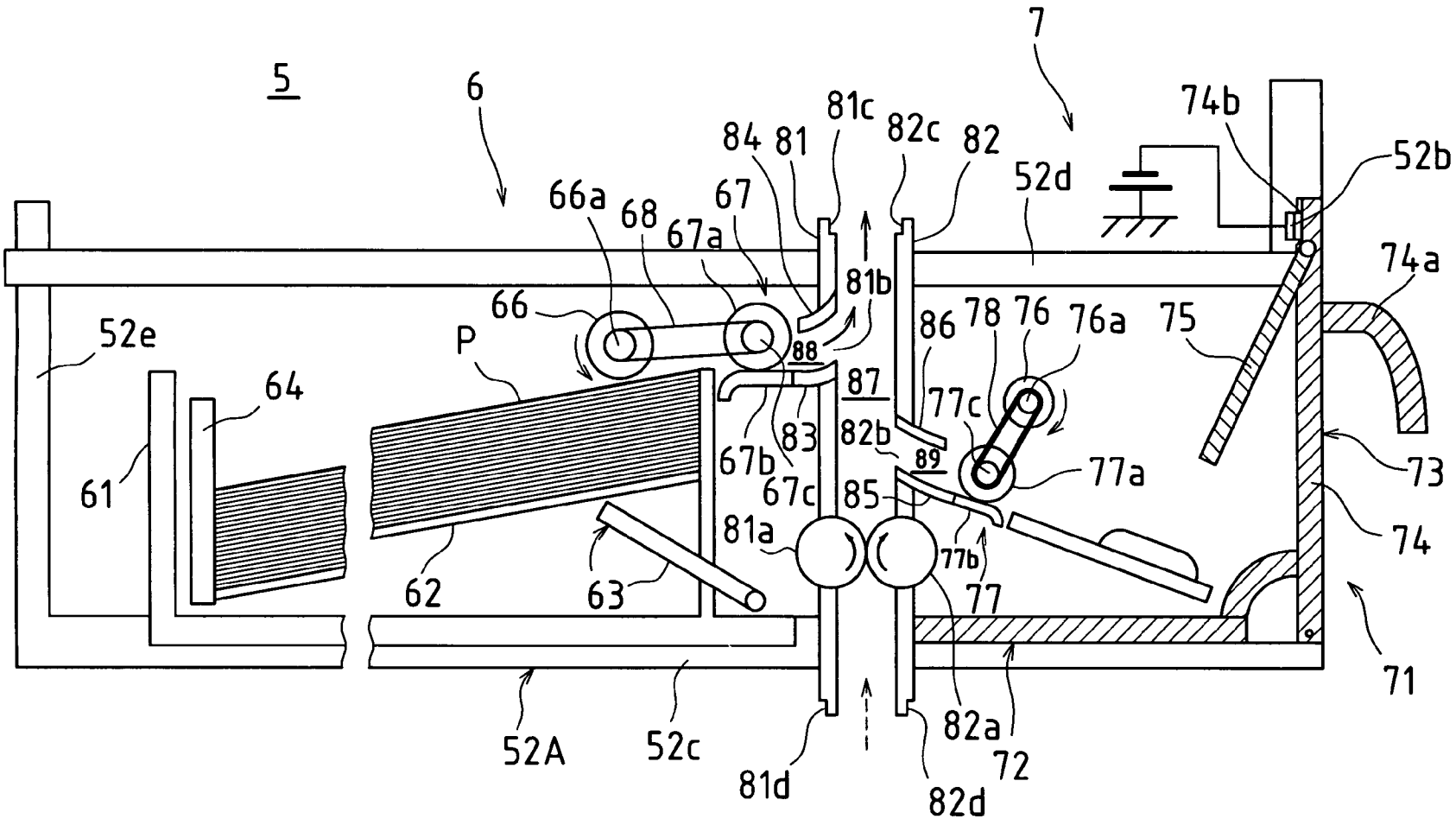
FIG. 4 is a drawing showing in schematic fashion a simplified rendering of the constitution at the interior of a hybrid paper supply module.

As shown in FIGS. 3 and 4, automatic-feed cassette mechanism unit 6 is provided with the aforementioned automatic-feed cassette 61 constructed in the form of a container which is open at the top; and pivotably supported at the interior of this automatic-feed cassette 61 is pivot plate 62, which is made of metal and serves as paper storage plate. In addition, this automatic-feed cassette 61 is capable of being pulled outward from the aforementioned module casing 52A and toward the front side (the near side at FIG. 1) of hybrid device 1, procedures for replenishing this automatic-feed cassette 61 with recording paper being made possible when this automatic-feed cassette 61 has been pulled outward therefrom.

The aforementioned pivot plate 62 is supported so as to permit it to pivot in a vertical direction about a pivot shaft extending in the direction of the width (i.e., perpendicular to the plane of the paper in FIG. 4) of automatic-feed cassette 61, and the bottom thereof is abutted by lift plate 63 which is imparted with an upward torque. In other words, as a result of the restoring force from lift plate 63, this pivot plate 62 is constantly acted upon by an upward restoring force. Note that a coil spring may be provided instead of this lift plate 63, in which case it would be the restoring force from the coil spring that would cause this pivot plate 62 to constantly be acted upon by an upward restoring force.

Furthermore, provided at one end (the right end in FIG. 4) within automatic-feed cassette 61 are paper lead edge alignment tabs, not shown, for pressing against the lead edge of recording paper P and aligning this recording paper P, and the corners of the lead edge of recording paper P are pressed downward from above by these paper lead edge alignment tabs. For this reason, when recording paper P is loaded within automatic-feed cassette 61, pivot plate 62 pivots upward due to the restoring force from lift plate 63, the rotational position thereof being constrained at the position at which the corners of the lead edge of recording paper P abut the paper lead edge alignment tabs. With automatic-feed cassette 61 in this state it is pushed into module casing 52A; and as a result, a multiplicity of sheets of recording paper are loaded into automatic-feed cassette mechanism unit 6.

Furthermore, paper trail edge guide member 64, which positions the trail edge of recording paper P in the feed direction, is attached at the interior of the aforementioned automatic-feed cassette 61. Furthermore, paper side edge guide members 65, 65, for positioning the two edges of recording paper P at sides perpendicular to the feed direction, are also attached thereto. Note that hybrid paper supply module 5 associated with the present embodiment stores recording paper P such that it is centered in the paper width direction. This being the case, respective paper side edge guide members 65, 65 are respectively attached at locations mutually equidistant from the center in the width direction (i.e., direction perpendicular to the plane of the paper in FIG. 4) of automatic-feed cassette 61.

Respectively provided at the paper discharge side of automatic-feed cassette mechanism unit 6 are paper separator mechanism 67 and takeup roller(s) 66 constituting a paper takeup mechanism.

The aforementioned paper separator mechanism 67 is equipped with separator roller(s) 67*a* and separator plate(s) 67*b*. Separator plate 67*b* is such that the force of friction between the top surface thereof (the surface coming in contact with recording paper P) and recording paper P is set so as to be greater than the force of friction between sheets of recording paper P, P. Furthermore, separator roller 67*a* is such that the force of friction between this separator roller 67*a* and recording paper P is set so as to be greater than the force of friction between the top surface of separator plate 67*b* and recording paper P and greater than the force of friction between respective sheets of recording paper P, P. For this reason, even if multiple sheets of recording paper P, P, . . . are taken up from automatic-feed cassette 61 and are fed to paper separator mechanism 67, separator roller 67*a* will be able to separate these multiple sheets of recording paper P, P, . . . and feed only the topmost sheet of recording paper P to paper supply path(s), described below.

Pulleys 67*c*, 66*a* are respectively provided on the shafts of the aforementioned separator roller 67*a* and takeup roller 66, belt 68 spanning these pulleys 67*c*, 66*a*. In addition, drive force from a drive motor, not shown, is transmitted to separator roller 67*a*, and the motor drive force transmitted to this separator roller 67*a* is transmitted to takeup roller 66 by way of belt 68. Furthermore, the shafts of this separator roller 67*a* and this takeup roller 66 are supported by the same support plate (depiction of which is omitted in FIG. 4); and in accompaniment to transmission of drive force from the aforementioned motor to separator roller 67*a*, this support plate pivots (rotating in counterclockwise fashion as viewed in FIG. 4) about the shaft of separator roller 67*a*, causing takeup roller 66 to press against the top surface of recording paper P within automatic-feed cassette 61 (the situation existing following conclusion of such pivoting being shown in FIG. 4). In other words, the constitution is such that in accompaniment to driving of the aforementioned motor, takeup roller 66 presses against recording paper P within automatic-feed cassette 61 and takes up recording paper P from this automatic-feed cassette 61; and separation of recording paper P being carried out by paper separator mechanism 67, only one sheet of recording paper P is fed from automatic-feed cassette 61 to the paper supply path.

Description of Manual-Feed Mechanism Unit 7

As shown in FIGS. 3 and 4, manual-feed mechanism unit 7 is equipped with the aforementioned manual-feed tray 71. As shown in FIG. 4, this manual-feed tray 71 is equipped with tray base 72, which is supported by module casing 52A; and manual-feed tray main body 73, which is supported so as to permit it to pivot relative to this tray base 72 by means of pivot shaft(s) extending horizontally.

Moreover, this manual-feed tray main body 73 is equipped with first tray 74, which is supported so as to permit it to pivot relative to tray base 72 by means of pivot shaft(s) extending horizontally; and second tray 75, which is supported so as to permit it to pivot relative to the tip (the top end when in its stored state as shown in FIG. 4) of this first tray 74.

Figure 5:
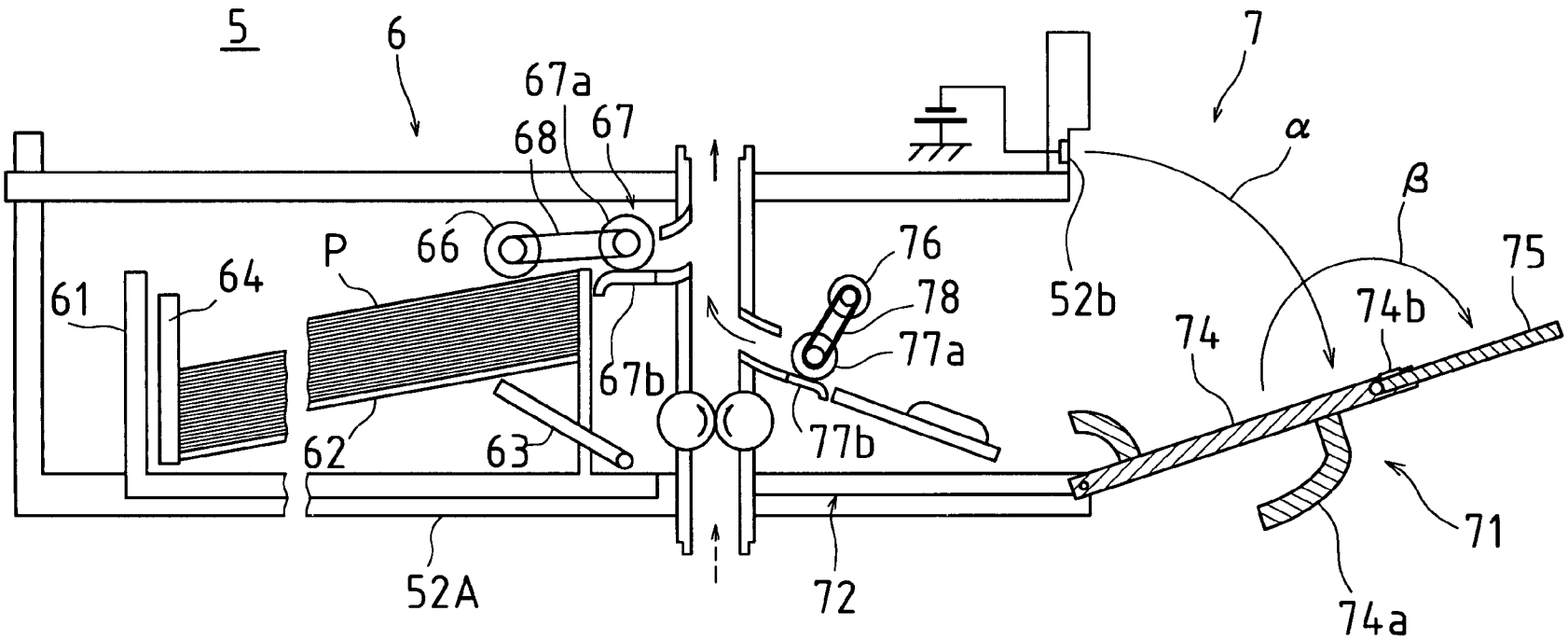
FIG. 5 is a drawing corresponding to FIG. 4 and showing a manual-feed tray in an opened state.

This being the case, in the event that paper is to be supplied from the present manual-feed mechanism unit 7, first tray 74 is made to pivot toward one side of the apparatus relative to tray base 72, and furthermore, second tray 75 is made to pivot toward one side of the apparatus relative to first tray 74. As a result, as shown in FIG. 5, the respective inside surfaces of first tray 74 and second tray 75 are made to lie in a single plane and face upward, permitting placement (manual loading) of recording paper P thereon over a region extending from first tray 74 to second tray 75. Moreover, the aforementioned first tray 74 is provided with deployment grip region 74*a* which is located on the side of the outside surface of the apparatus when first tray 74 is in its stored state as shown in FIG. 4, and by grabbing this grip region 74*a* and causing first tray 74 to swing downward and to the side of the apparatus, a user can cause this first tray 74 to assume its opened (deployed) state.

This grip region 74*a* is formed by a small projection formed in the central region of the outside surface of first tray 74, and by grabbing this grip region 74*a* with his or her finger and pivoting first tray 74 downward, a user can cause deployment (pivoting) of only first tray 74 (see arrow a in FIG. 5).

Furthermore, the aforementioned manual-feed tray 71 is provided with a pair of guide members 79, 79 (not shown in FIG. 3) constraining placement location(s) of recording paper P placed therein or thereon by abutting against respective edges of recording paper P in the width direction (i.e., the edges extending in the direction of transport of the recording paper P placed therein or thereon), these guide members 79, 79 being supported so as to permit movement in sliding fashion in or on manual-feed tray 71. At this manual-feed tray 71 as well, placement of recording paper P is such that it is centered in the paper width direction. For this reason, respective guide members 79, 79 are supported by a sliding mechanism, not shown, causing them to slide so as to mutually approach or recede in synchronous fashion.

Furthermore, manual-feed mechanism unit 7 of the present embodiment is such that it permits operations for opening of first tray 74 to be carried out automatically. More specifically, small metal piece 74*b* is attached to the tip region of the inside surface of first tray 74 (i.e., the top surface when in its opened state as shown in FIG. 5), and electromagnet 52*b* is provided at a location which is on the side surface of module casing 52A or the hybrid device main body and which opposes the aforementioned metal piece 74*b* when first tray 74 is in its stored state. A DC power supply is connected to this electromagnet 52*b*, the electromagnet being energized when electricity flows therethrough, electromagnetic attraction for the aforementioned metal piece 74*b* causing first tray 74 to be maintained in its stored state. Furthermore, when the user operates a control panel of hybrid device 1 or there is otherwise a request for supply of paper from manual-feed mechanism unit 7, electromagnet 52*b* is deenergized, terminating the electromagnetic attraction thereof for the aforementioned metal piece 74*b* and causing first tray 74 to pivot under its own weight so as to cause it to go from its stored state to its opened state.

Respectively provided at the paper discharge side of the present manual-feed mechanism unit 7 are paper separator mechanism 77 and paper pickup roller(s) 76 constituting a paper takeup mechanism.

The aforementioned paper separator mechanism 77 is equipped with separator roller(s) 77*a* and separator plate(s) 77*b*. As the constitution of these is similar to that at the aforementioned paper separator mechanism 67 provided at automatic-feed cassette mechanism unit 6, description is omitted here.

In addition, pulleys 77*c*, 76*a* are respectively provided on the shafts of the aforementioned separator roller 77*a* and paper pickup roller 76, belt 78 spanning these pulleys 77*c*, 76*a*. In addition, drive force from a drive motor, not shown, is transmitted to separator roller 77*a*, and the motor drive force transmitted to this separator roller 77*a* is transmitted to paper pickup roller 76 by way of belt 78. Furthermore, the shafts of this separator roller 77*a* and this paper pickup roller 76 are supported by the same support plate (not shown); and in accompaniment to transmission of drive force from the aforementioned motor to separator roller 77*a*, this support plate pivots about the shaft of separator roller 77*a*, causing paper pickup roller 76 to press against the top surface of recording paper P lying on manual-feed tray 71. In other words, the constitution is such that in accompaniment to driving of the aforementioned motor, paper pickup roller 76 presses against recording paper P lying on manual-feed tray 71 and takes up recording paper P from this manual-feed tray 71; and separation of recording paper P being carried out by paper separator mechanism 77, only one sheet of recording paper P is fed from manual-feed tray 71 to the paper supply path.

Paper Supply Path

Next, the paper supply path (the path internal to hybrid paper supply module 5) for transporting toward main transport path 36 recording paper P that has been taken up by automatic-feed cassette mechanism unit 6 or manual-feed mechanism unit 7, having constitutions as described above, will be described.

This paper supply path is made up of first through sixth guide members 81 through 86. First guide member 81 and second guide member 82 are installed between the aforementioned automatic-feed cassette mechanism unit 6 and manual-feed mechanism unit 7 so as to extend vertically and so as to have a prescribed distance therebetween horizontally. More specifically, first guide member 81 is installed at automatic-feed cassette mechanism unit 6, and second guide member 82 is installed at manual-feed mechanism unit 7; regions in the vicinities of the bottom edges of respective guide members 81, 82 being attached to base section 52*c* of module casing 52A, and regions in the vicinities of the top edges of respective guide members 81, 82 being attached to top section 52*d* of module casing 52A. This being the case, primary path 87, extending vertically, is formed between the two guide members 81, 82; the lower end (upstream end) of this primary path 87 being open to the exterior from base section 52*c* of module casing 52A, and the upper end (downstream end) of this primary path 87 being open to the exterior from top section 52*d* of module casing 52A.

Furthermore, respectively installed at the aforementioned first guide member 81 and second guide member 82 are transport rollers 81*a*, 82*a* which are supported so as to permit rotation about horizontal axes (i.e., about horizontal axes extending in the direction of the width of recording paper P contained therewithin), the outside circumferential surfaces of these transport rollers 81*a*, 82*a* coming in contact with each other. Drive force from a motor, not shown, is transmitted to one of these transport rollers 81*a*, 82*a* (directions of rotation being indicated by arrows in FIG. 4), permitting recording paper P as it is transported within primary path 87 to be transported therealong by virtue of the nip formed between these transport rollers 81*a*, 82*a*. Moreover, provided at the respective top and bottom ends of the aforementioned first guide member 81 and second guide member 82 there are engagement ridges 81*c*, 82*c*, 81*d*, 82*d* for mutual positioning when like hybrid paper supply modules 5 are stacked together such that one is atop the other.

Third guide member 83 is formed so as to be continuous with separator plate 67*b* of the aforementioned automatic-feed cassette mechanism unit 6 and is made up of a plate which is curved so as to be directed upward toward the aforementioned primary path 87. Furthermore, fourth guide member 84, installed at a location causing it to be a prescribed distance from the top surface of the aforementioned third guide member 83, is made up of a plate which is curved so as to be directed upward toward primary path 87. In addition, the ends of this third guide member 83 and this fourth guide member 84 are connected to the periphery of opening 81*b* formed in first guide member 81. As a result, automatic-feed path 88, for transporting to primary path 87 recording paper P that has been taken up from automatic-feed cassette mechanism unit 6, is formed between third guide member 83 and fourth guide member 84.

Fifth guide member 85 is formed so as to be continuous with separator plate 77*b* of the aforementioned manual-feed mechanism unit 7 and is made up of a plate which is curved so as to be directed upward toward the aforementioned primary path 87. Furthermore, sixth guide member 86, installed at a location causing it to be a prescribed distance from the top surface of the aforementioned fifth guide member 85, is made up of a plate which is curved so as to be directed upward toward primary path 87. In addition, the ends of this fifth guide member 85 and this sixth guide member 86 are connected to the periphery of opening 82*b* formed in second guide member 82. As a result, manual-feed path 89, for transporting to primary path 87 recording paper P that has been taken up from manual-feed mechanism unit 7, is formed between fifth guide member 85 and sixth guide member 86.

Because the paper supply path is formed as described above, recording paper P, whether taken up from automatic-feed cassette mechanism unit 6 or manual-feed mechanism unit 7, after passing through the aforementioned primary path 87 provided at the interior of hybrid paper supply module 5 is introduced into main transport path 36 and arrives at printing unit 3, where prescribed image forming operation take place. Accordingly, there is only one path (main transport path 36) by which recording paper P is discharged in going toward printing unit 3 from the discharge side of hybrid paper supply module 5, eliminating the need to have two paths at the hybrid device 1 main body such as would be the case were there one path for the automatic-feed cassette and another path for the manual-feed tray. This being the case, not only is it possible to shorten the length of the overall transport path of hybrid device 1 and achieve simplification of the constitution at the interior of hybrid device 1, but it is also possible to reduce the number of locations at which paper jams can occur, and it is possible to reduce the frequency of occurrence of paper jams.

As shown in FIG. 2, in the present embodiment, a plurality of hybrid paper supply modules 5, 5, . . . are arranged so as to be stacked together below hybrid device 1. Thus, when respective hybrid paper supply modules 5, 5, . . . are stacked together, primary paths 87 provided at respective hybrid paper supply modules 5, 5, . . . communicate in vertically collinear fashion.

Accordingly, when recording paper P is taken up from the uppermost (i.e., that which is located furthest downstream in the recording paper P transport direction) hybrid paper supply module 51, recording paper P taken up from automatic-feed cassette mechanism unit 6 or manual-feed mechanism unit 7 of this hybrid paper supply module 51 is transported to main transport path 36 by way of primary path 87 at the interior of this hybrid paper supply module 51 (see arrows drawn with solid lines at FIGS. 4 and 5).

On the other hand, when recording paper P is taken up from the hybrid paper supply module 52 that is second from the top (i.e., that is second as counted from an extreme downstream location in the recording paper P transport direction), recording paper P taken up from automatic-feed cassette mechanism unit 6 or manual-feed mechanism unit 7 of this hybrid paper supply module 52 is transported to main transport path 36 by way of primary path 87 at the interior of this hybrid paper supply module 52 and primary path 87 at the interior of hybrid paper supply module 51 (arrows drawn with dashed lines at FIGS. 4 and 5 indicate paper transport direction at the interior of this hybrid paper supply module 51).

In like fashion, when recording paper P is taken up from the hybrid paper supply module 53 that is third from the top (i.e., that is third as counted from an extreme downstream location in the recording paper P transport direction), recording paper P taken up therefrom is transported to main transport path 36 after passing in sequence through primary path 87 at the interior of this hybrid paper supply module 53 and primary paths 87 at the interiors of hybrid paper supply modules 52, 51.

Thus, by passing through primary path(s) 87 at interior(s) of hybrid paper supply module(s) located downstream therefrom in the transport direction, recording paper P can be smoothly transported to main transport path 36 regardless of from which among hybrid paper supply modules 51 through 54 it is that recording paper P is taken up.

Moreover, as has been described above, paper trail edge guide member 64 and paper side edge guide members 65, 65 provided at automatic-feed cassette mechanism unit 6 of each hybrid paper supply module 5 are attached (fixed) to the base of automatic-feed cassette 61. This being the case, automatic-feed cassette mechanism units 6 of respective hybrid paper supply modules 5 are each capable of containing a single, fixed size of recording paper P. That is, each automatic-feed cassette mechanism unit 6 is set so as to exclusively accept one specific size of recording paper P. For example, at FIG. 2, topmost-stacked hybrid paper supply module 51 might contain B5-size paper, second-highest hybrid paper supply module 52 might contain A4-size paper, third-highest hybrid paper supply module 53 might contain B4-size paper, and bottommost-stacked hybrid paper supply module 54 might contain A3-size paper. But of course the present invention is not limited hereto.

Furthermore, as has been described above, guide members 79, 79 provided at manual-feed mechanism unit 7 of each hybrid paper supply module 5 are supported so as to permit movement in sliding fashion in or on manual-feed tray 71.

This being the case, manual-feed mechanism units 7 of respective hybrid paper supply modules 5 are each not limited to accepting placement therein or thereon of a single size of recording paper P, but are each capable of accepting placement therein or thereon of a variety of sizes of recording paper P. Accordingly, in carrying out paper feed operations, a user may, without regard to paper size, use any arbitrary manual-feed mechanism unit 7. For example, in the event that topmost-stacked hybrid paper supply module 51 lends itself to convenient usage, manual-feed mechanism unit 7 of this hybrid paper supply module 51 may be used regardless of the size of recording paper P. Or in the event that recording paper P of a different size has already been placed in or on this topmost-stacked hybrid paper supply module 51, it is possible to use another hybrid paper supply module. That is, there is no need to perform the task of removing recording paper P from where it has already been placed, it being possible to carry out paper feed operations using another hybrid paper supply module. Or where there are zero or a small number of sheets remaining in an automatic-feed cassette 61 which is intended to contain recording paper P of a particular size (e.g., A4 size in a situation where various sizes of paper are contained in respective hybrid paper supply modules 5 as described above, and the number of sheets of A4-size paper remaining at second-highest hybrid paper supply module 52 is zero), any arbitrary manual-feed mechanism unit 7 might be used to carry out image formation on the required number of sheets of paper of that size. That is, it is possible to quickly cause image forming operations to be completed on the required number of sheets of recording paper P, without the need to perform the task of replenishing paper at automatic-feed cassette 61 (i.e., the task of pulling out automatic-feed cassette 61, loading paper, and pushing automatic-feed cassette 61 thereinto).

Furthermore, of the respective hybrid paper supply modules 51 through 54 in the present embodiment, the length (i.e., dimension in the vertical direction when stored) of manual-feed tray 71 of topmost-stacked hybrid paper supply module 51 is set so as to be greater than the length(s) of the other manual-feed trays 71. The length(s) (i.e., dimension(s) in vertical direction when stored) of manual-feed trays 71 of the other hybrid paper supply modules 52 through 54 are approximately equal to the height(s) of module casing(s) 52A, and these manual-feed trays 71 constitute side surface(s) of module casing(s) 52A when stored. However, manual-feed tray 71 of topmost-stacked hybrid paper supply module 51 is such that this manual-feed tray 71, when in its stored state, constitutes the side surface of module casing 52A; but in addition thereto, the top edge portion of manual-feed tray 71 extends further upward than the top edge of module casing 52A so as to be contained within recess 11 formed at the side surface of the hybrid device casing.

Paper Feed Operations

Figure 6:
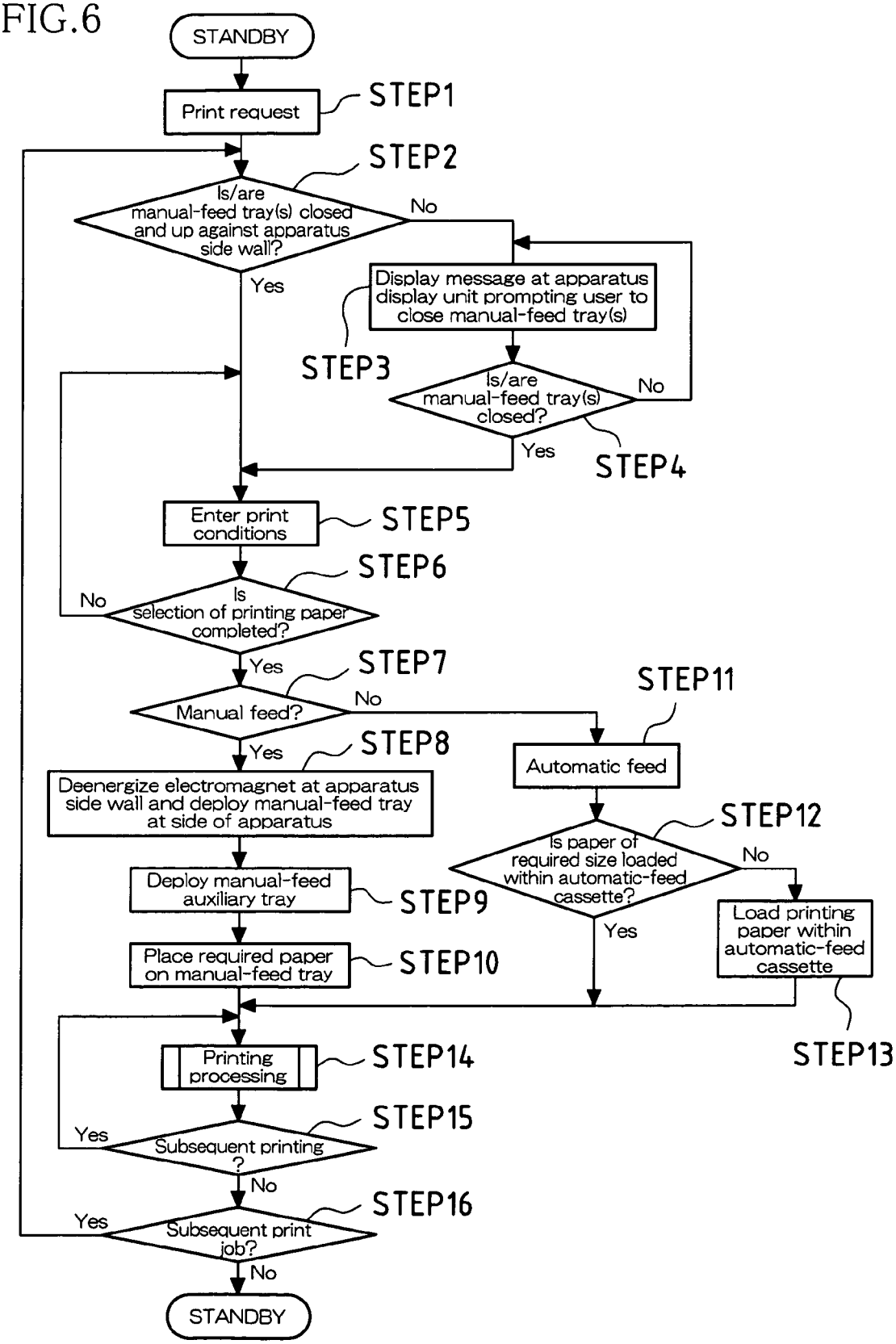
FIG. 6 is a flowchart for explaining paper feed operations carried out by a hybrid paper supply module.

Following the flowchart of FIG. 6, paper feed operations carried out by hybrid paper supply module(s) 5 having the foregoing constitution will next be described.

First, if at STEP1 the user operates a control panel of hybrid device 1 (or operates a host device connected thereto) or there is otherwise a request to carry out printing, then at STEP2 determination is made as to whether manual-feed trays 71 of all manual-feed mechanism units 7 are in stored states; i.e., whether each manual-feed mechanism unit 7 is closed off by the side wall of hybrid paper supply module 5. If any manual-feed tray(s) 71 is/are not in stored state(s), i.e., if manual-feed tray(s) 71 is/are in opened state(s), then processing proceeds to STEP3, at which notice is given at a display unit (display panel) of the apparatus that manual-feed tray(s) 71 should be put into stored state(s) (i.e., that manual-feed mechanism unit(s) 7 should be closed). Furthermore, if at STEP4 it is detected that manual-feed tray(s) 71 has or have been stored (manual-feed mechanism unit(s) 7 has or have been closed), then processing proceeds to STEP5.

The user enters print conditions (STEP5); and upon selection of printing paper (i.e., the type of recording paper P to be used for image formation), the value at STEP6 goes to YES, and processing proceeds to STEP7. Here, determination is carried out as to whether the selected print conditions are such that the paper supply source is manual-feed mechanism unit 7. If this is determined to be YES, then processing proceeds to STEP8, at which the aforementioned electromagnet 52*b* is turned OFF, opening manual-feed tray 71 of a specific manual-feed mechanism unit 7 (i.e., manual-feed tray 71 swings down from the side of hybrid paper supply module 5: arrow a in FIG. 5). Furthermore, after, where necessary, carrying out (at STEP9) a procedure (arrow p in FIG. 5) in which second tray 75 serving as auxiliary tray is made to pivot (i.e., is opened), recording paper P is placed on manual-feed tray 71 (STEP10), and processing proceeds to STEP14.

Conversely, if the answer as determined at STEP7 is NO, then it is determined (STEP11) that the paper supply source pursuant to the selected print conditions is automatic-feed cassette mechanism unit 6; and at STEP12, determination is carried out as to whether there is/are automatic-feed cassette(s) 61 of automatic-feed cassette mechanism unit(s) 6 that contain recording paper P of the required size (recording paper P consistent with the foregoing print conditions). If the result of this determination is YES, then processing proceeds to STEP14; but if the result of this determination is NO, then at STEP13 the user carries out operations for loading of recording paper P consistent with print conditions, following which processing proceeds to STEP14. As examples of this determination as to whether recording paper P consistent with print conditions is loaded therein, paper sensor(s) might be provided at automatic-feed cassette 61, and type(s) (size(s) and/or orientation(s)) of loaded recording paper P might be detected by such sensor(s) and displayed at display panel(s), with determination being carried out pursuant to confirmation of such display by the user; or a warning might be issued to the user in the event that type(s) of recording paper P loaded in automatic-feed cassette 61 as confirmed by hybrid device 1 is/are different from type(s) of recording paper P at the foregoing print conditions, prompting the user to carry out operations for loading of recording paper P consistent with print conditions; and so forth.

Moreover, printing processing is carried out at STEP14; and after paper has been supplied from the desired mechanism unit and image forming has at printing unit 3 been carried out on that recording paper P, operations are carried out for discharge thereof to discharge tray 35.

After printing operations have been carried out on this single sheet of recording paper P, determination is made at STEP15 as to whether there is subsequent printing to be carried out (i.e., whether subsequent print information exists); the operations at STEPS 14 and 15 being carried out in repeated fashion until subsequent print information does not exist. Moreover, when subsequent print information no longer exists, determination is carried out at STEP16 as to whether subsequent print job(s) exist; and in the event that there is/are subsequent print job(s), processing returns to STEP2; the foregoing operations being carried out in repeated fashion until subsequent print job(s) no longer exist.

Benefits of First Embodiment

Because, in the present embodiment, automatic-feed cassette mechanism unit(s) 6 and manual-feed mechanism unit(s) 7 may be incorporated into a single integral hybrid paper supply module 5 as described above, it is possible for manual-feed mechanism unit(s) 7 to be arranged so as to be stacked vertically with respect to flipping transport path(s) 37 and main transport path(s) 36 extending so as to be directed toward printing unit(s) 3 of hybrid device(s) 1, as a result of which it is possible to shorten dimension(s) of hybrid device(s) 1 and achieve reduction in the amount of space required for installation.

Furthermore, this hybrid paper supply module 5 makes it possible to cause the path along which recording paper P taken up from automatic-feed cassette mechanism unit 6 is transported and the path along which recording paper P taken up from manual-feed mechanism unit 7 is transported to intersect at the interior of module 5, and makes it possible to decrease the lengths of the respective paths. This being the case, the length of the overall paper transport path of the apparatus can be shortened, the number of locations at which paper jams can occur can be reduced, and image forming operations at the apparatus can be carried out in stable fashion.

Furthermore, even where a plurality of hybrid paper supply modules 5, 5, . . . are stacked together, recording paper P can be made to pass through interior(s) of respective module(s) and this recording paper P may be supplied to printing unit(s) 3 of hybrid device(s) 1. This being the case, it is possible to improve the degree to which such hybrid paper supply module(s) 5 lend themselves to practical application.

Other Embodiments

Whereas in the foregoing embodiments the present invention has been described in terms of an example in which it is applied to a multifunction image forming apparatus (hybrid device) 1 combining the functions of copier, printer, and facsimile machine, the present invention is not limited thereto but may also be applied to an image forming apparatus provided with any one function, and to other image forming apparatuses as well.

Furthermore, whereas manual-feed tray 71 of manual-feed mechanism unit 7 was of folding type and permitted adjustment of length in two stages; the present invention is not limited thereto, it being possible for the structure to be of pullout type such that adjustment of length is permitted, and/or it is also possible to adopt a constitution in which length is adjustable in three or more stages.

Furthermore, hybrid paper supply module 5 associated with the present invention is not limited to situations in which a plurality thereof are stacked together, but there are also instances in which it may be used singly (i.e., in constitutions in which image forming apparatus(es) is/are provided with only a single hybrid paper supply module 5).

Below, other embodiments, in which constitution(s) of hybrid device(s) associated therewith is/are different from that associated with the foregoing first embodiment, are described below.

Second Embodiment

The following embodiment of the present invention is described with reference to the drawings. Note at the present second embodiment that there is a hybrid device of constitution identical to that associated with the foregoing first embodiment. This being the case, at the present second embodiment, like components are given like reference numerals and description thereof is omitted.

—Description of Overall Constitution of Hybrid Device—

FIG. 1 shows in schematic fashion the internal constitution of hybrid device 1 which serves as image forming apparatus associated with the present embodiment. Furthermore, FIG. 2 shows in schematic fashion the respective constitutions at the interiors of a plurality of hybrid paper supply modules 5, 5, . . . that have been stacked together, same being characteristic of one or more embodiments of the present invention. As shown in FIG. 1, hybrid device 1 is provided with scanning unit 2, printing unit 3 serving as image forming unit, and automatic original feed unit 4.

—Description of Hybrid Paper Supply Module 5—

The aforementioned hybrid paper supply module 5, being a characteristic feature of the present embodiment, will next be described. As shown in FIGS. 1 and 2, the present hybrid device 1 is equipped with a paper supply mechanism made up of a plurality of hybrid paper supply modules 5, 5, . . . that have been stacked together. Because respective hybrid paper supply modules 5, 5, . . . are all of more or less identical constitution, description is here carried out in terms of one hybrid paper supply module 5 taken to be representative thereamong. Moreover, each of these hybrid paper supply modules 5, 5, . . . is here assumed to be capable of accommodating a single paper size. This being the case, only the constitution of manual-feed mechanism unit 7 and the constitution for positioning recording paper P at automatic-feed cassette mechanism unit 6 will be mutually different. In the description that follows, description is carried out in terms of the topmost-stacked hybrid paper supply module 5 which is taken to be exemplary thereamong.

Figure 7:
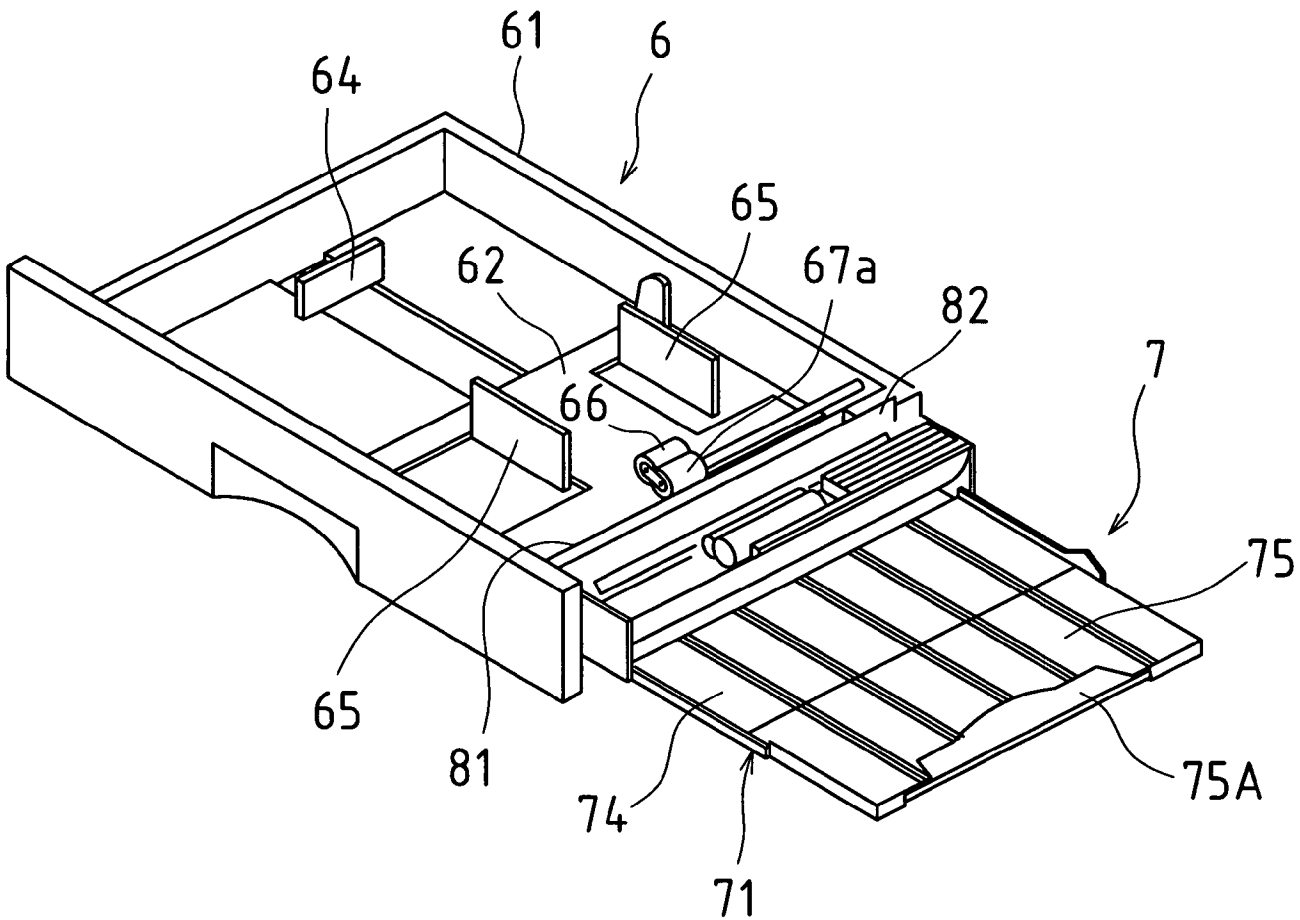
FIG. 7 is an oblique partial cutaway view of a hybrid paper supply module.

FIG. 7 is an oblique partial cutaway view of automatic-feed cassette mechanism unit 6 and manual-feed mechanism unit 7 of hybrid paper supply module 5. Furthermore, FIG. 8 is a drawing showing in schematic fashion a simplified rendering of the constitution at the interior of this hybrid paper supply module 5.

As shown in the respective drawings, hybrid paper supply module 5 is constructed such that the foregoing automatic-feed cassette mechanism unit 6 and manual-feed mechanism unit 7 are contained within module casing 52A, which constitutes the housing of the present module 5.

Description of Automatic-Feed Cassette Mechanism Unit 6

Figure 8:
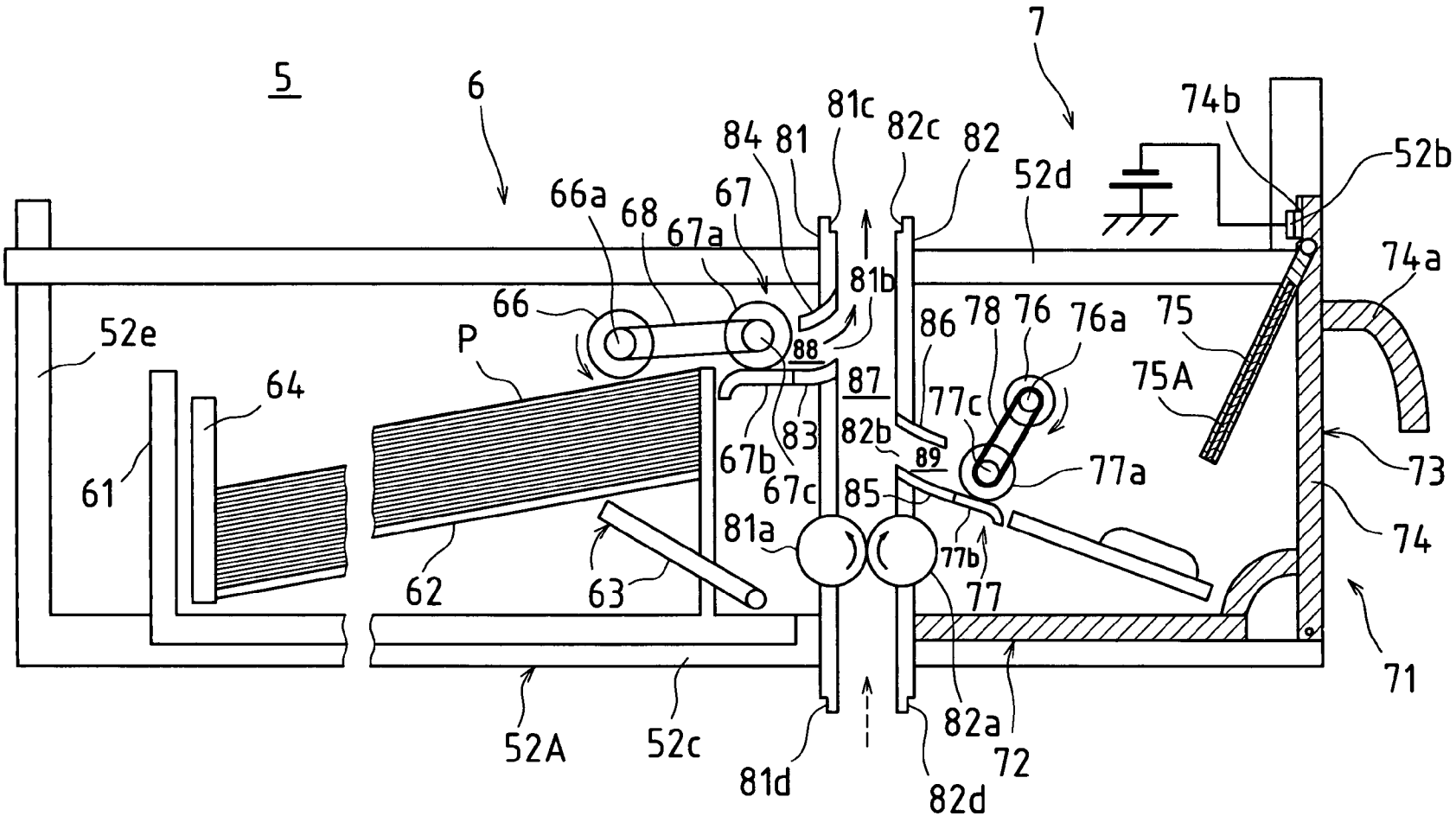
FIG. 8 is a drawing showing in schematic fashion a simplified rendering of the constitution at the interior of a hybrid paper supply module.

As shown in FIGS. 7 and 8, automatic-feed cassette mechanism unit 6 is provided with the aforementioned automatic-feed cassette 61 constructed in the form of a container which is open at the top; and pivotably supported at the interior of this automatic-feed cassette 61 is pivot plate 62, which is made of metal and serves as paper storage plate.

Furthermore, paper trail edge guide member 64, which positions the trail edge of recording paper P in the feed direction, is fixed to the interior of the aforementioned automatic-feed cassette 61. Furthermore, paper side edge guide members 65, 65, for positioning the two edges of recording paper P at sides perpendicular to the feed direction, are also fixed thereto. Note that hybrid paper supply module 5 associated with the present embodiment stores recording paper P such that it is centered in the paper width direction. This being the case, respective paper side edge guide members 65, 65 are respectively attached at locations mutually equidistant from the center in the width direction (i.e., direction perpendicular to the plane of the paper in FIG. 8) of automatic-feed cassette 61. The magnitude of the gap between these equidistant locations is determined by the size of recording paper P to be contained therewithin.

Description of Manual-Feed Mechanism Unit 7

As shown in FIGS. 7 and 8, manual-feed mechanism unit 7 is equipped with first tray 74, which is supported so as to permit it to pivot relative to tray base 72 by means of pivot shaft(s) extending horizontally; second tray 75, which is supported so as to permit it to pivot relative to the tip (the top end when in its stored state as shown in FIG. 8) of this first tray 74; and third tray 75A, which is contained within second tray 75 and which is capable of being pulled out from this second tray 75. That is, this manual-feed tray 71 is constituted such that it can be collapsed in such fashion as to decrease its total length and permit it to be stored at the side of module casing 52A when not in use, and such that it can be deployed in such fashion as to permit its total length to be varied when in use.

Figure 11:
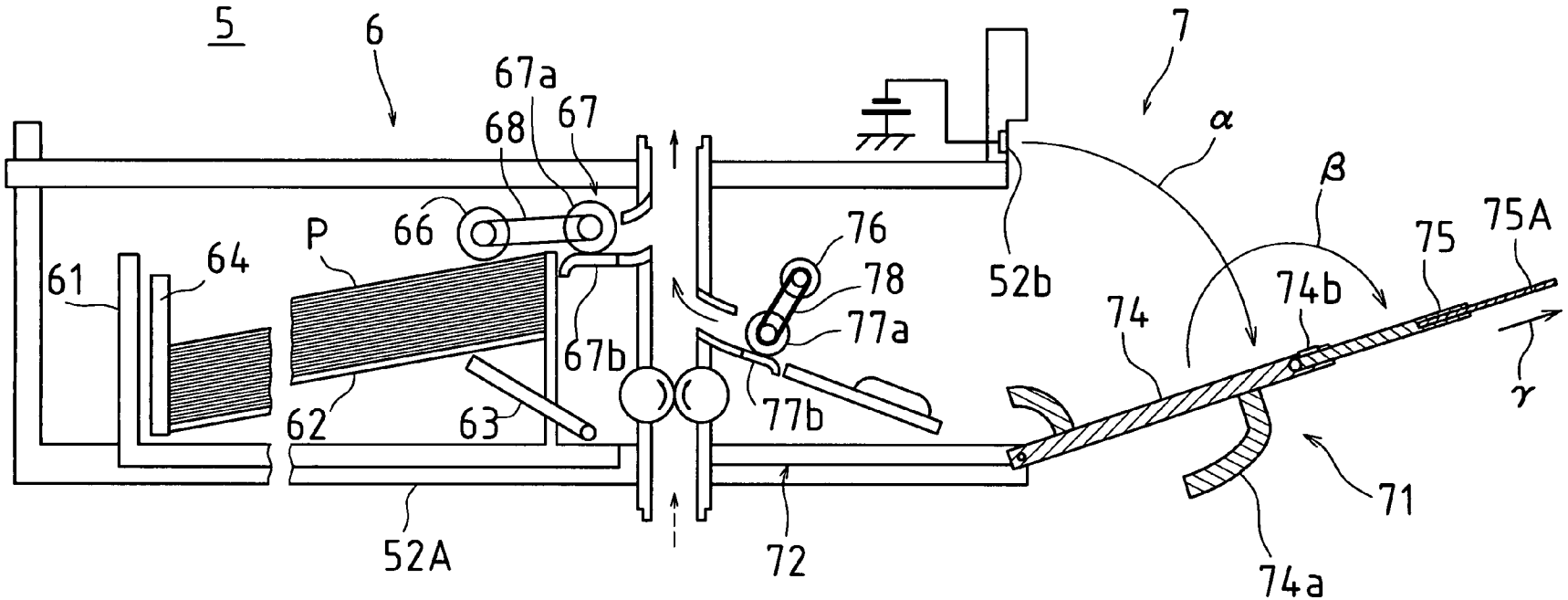
FIG. 11 is a drawing corresponding to FIG. 8 and showing a situation in which a first tray and a second tray have been made to pivot toward one side of the apparatus, and a third tray has been pulled out from the second tray.

This being the case, in the event that paper is to be supplied from the present manual-feed mechanism unit 7, first tray 74 is made to pivot toward one side of the apparatus relative to tray base 72, second tray 75 is made to pivot toward one side of the apparatus relative to first tray 74, and third tray 75A is pulled out from second tray 75 (see arrows α, β, and γ in FIG. 11). As a result, as shown in FIG. 11, the region extending from first tray 74 to third tray 75A is made to lie in a single plane and face upward, permitting placement (manual loading) of recording paper P on these trays 74, 75, 75A.

Moreover, note that at a different manual-feed mechanism unit 7 in which recording paper P of relatively small size (e.g., A4-size paper) is to be placed, the foregoing third tray 75A not being provided, first tray 74 is made to pivot toward one side of the apparatus relative to tray base 72, and second tray 75 is made to pivot toward one side of the apparatus relative to first tray 74, as a result of which the respective inside surfaces of first tray 74 and second tray 75 are made to lie in a single plane and face upward, permitting placement (manual loading) of recording paper P thereon over a region extending from first tray 74 to second tray 75.

At a different manual-feed mechanism unit 7 in which recording paper P of still smaller size (e.g., B5-size paper) is to be placed, neither the foregoing second tray 75 nor the foregoing third tray 75A being provided, first tray 74 is made to pivot toward one side of the apparatus relative to tray base 72, as a result of which the inside surface of first tray 74 is made to face upward, permitting placement (manual loading) of recording paper P on this first tray 74.

Furthermore, in accompaniment to each of the operations described above, manual-feed path 89, which is described below and which is the recording medium transport path of manual-feed mechanism unit 7, is opened up to the exterior (i.e., assumes a state permitting introduction of recording paper P thereinto).

Moreover, the aforementioned first tray 74 is provided with deployment grip region 74*a* which is located on the side of the outside surface of the apparatus when first tray 74 is in its stored state as shown in FIG. 8, and by grabbing this grip region 74*a* and causing first tray 74 to swing downward and to the side of the apparatus, a user can cause this first tray 74 to assume its opened (deployed) state.

Figure 9:
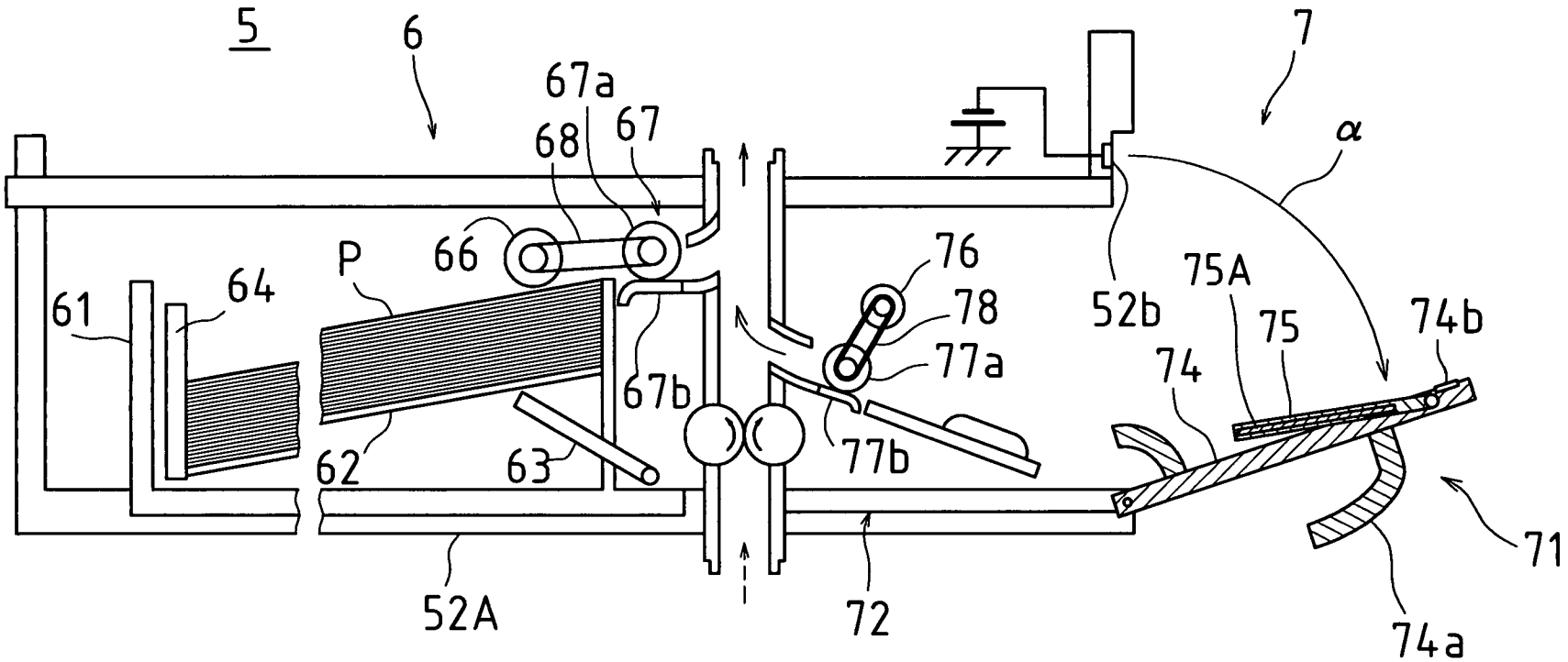
FIG. 9 is a drawing corresponding to FIG. 8 and showing a situation in which a first tray has been made to pivot toward one side of the apparatus.
Figure 10:
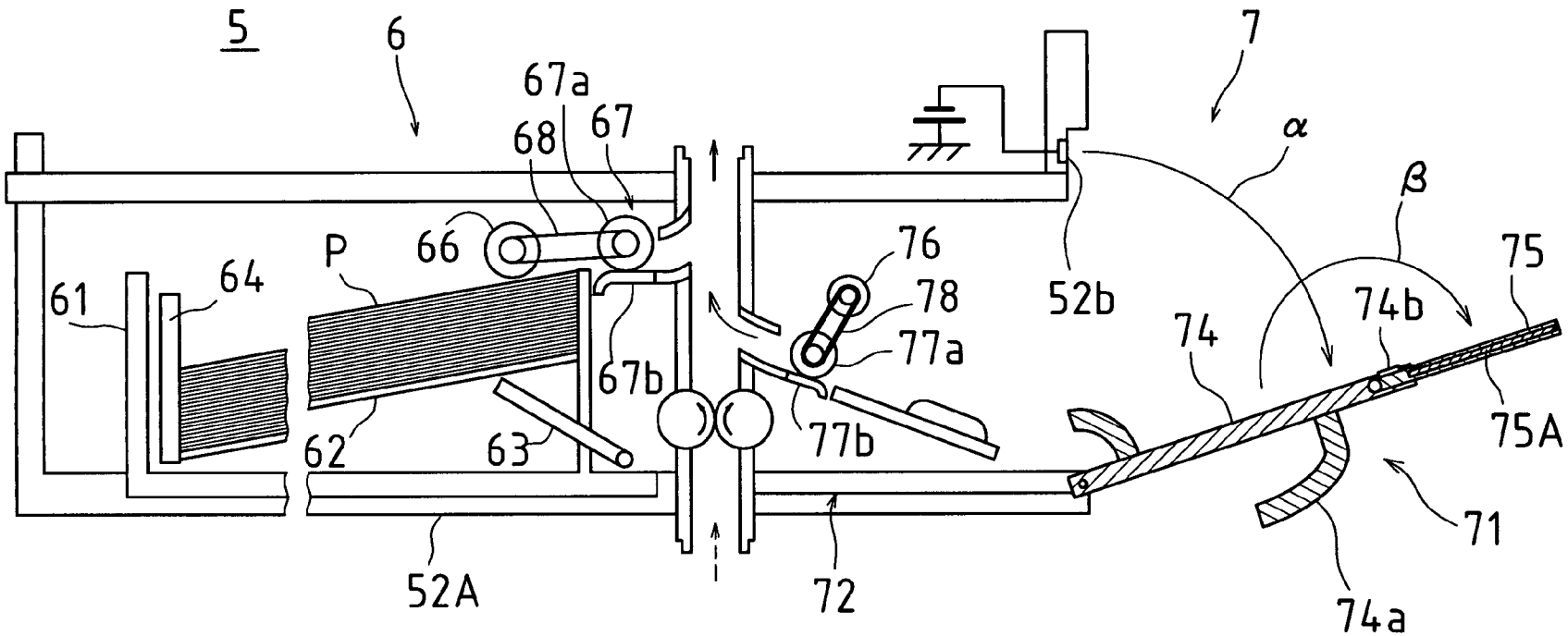
FIG. 10 is a drawing corresponding to FIG. 8 and showing a situation in which a first tray and a second tray have been made to pivot toward one side of the apparatus.

This grip region 74*a* is formed by a small projection formed in the central region of the outside surface of first tray 74, and by grabbing this grip region 74*a* with his or her finger and pivoting first tray 74 downward, a user can cause deployment (pivoting) of only first tray 74 (see arrow a in FIG. 9).

Furthermore, attached to the aforementioned manual-feed tray 71 are a pair of guide members 79, 79 (see FIG. 1; not shown in FIG. 7) constraining placement location(s) of recording paper P placed therein or thereon by abutting against respective edges of recording paper P in the width direction (i.e., the edges extending in the direction of transport of the recording paper P placed therein or thereon). At this manual-feed tray 71 as well, placement of recording paper P is such that it is centered in the paper width direction. This being the case, respective guide members 79, 79 are respectively attached at locations mutually equidistant from the center in the width direction (i.e., direction perpendicular to the plane of the paper in FIG. 8) of manual-feed tray 71. The magnitude of the gap between these equidistant locations is determined by the size of recording paper P to be placed therein or thereon.

Furthermore, manual-feed mechanism unit 7 of the present embodiment is provided with automatic deployment means in order to allow operations for opening of first tray 74 to be carried out automatically. More specifically, small metal piece 74*b* is attached to the tip region of the inside surface of first tray 74 (i.e., the top surface when in its opened state as shown in FIG. 9), and electromagnet 52*b* is provided at a location which is on the side surface of module casing 52A or the hybrid device main body and which opposes the aforementioned metal piece 74*b* when first tray 74 is in its stored state. A DC power supply is connected to this electromagnet 52*b*, the electromagnet being energized when electricity flows therethrough, electromagnetic attraction for the aforementioned metal piece 74*b* causing first tray 74 to be maintained in its stored state. Furthermore, when the user operates a control panel of hybrid device 1 or there is otherwise a request for supply of paper from a manual-feed mechanism unit 7, the electromagnet 52*b* corresponding to that request is deenergized, terminating the electromagnetic attraction thereof for the aforementioned metal piece 74*b* and causing first tray 74 to pivot under its own weight so as to cause it to go from its stored state to its opened state.

Respectively provided at the paper discharge side of the present manual-feed mechanism unit 7 are paper separator mechanism 77 and paper pickup roller(s) 76 constituting a paper takeup mechanism.

The aforementioned paper separator mechanism 77 is equipped with separator roller(s) 77*a* and separator plate(s) 77*b*. As the constitution of these is similar to that at the aforementioned paper separator mechanism 67 provided at automatic-feed cassette mechanism unit 6, description is omitted here.

In addition, pulleys 77*c*, 76*a* are respectively provided on the shafts of the aforementioned separator roller 77*a* and paper pickup roller 76, belt 78 spanning these pulleys 77*c*, 76*a*. In addition, drive force from a drive motor, not shown, is transmitted to separator roller 77*a*, and the motor drive force transmitted to this separator roller 77*a* is transmitted to paper pickup roller 76 by way of belt 78. Furthermore, the shafts of this separator roller 77*a* and this paper pickup roller 76 are supported by the same support plate (not shown); and in accompaniment to transmission of drive force from the aforementioned motor to separator roller 77*a*, this support plate pivots about the shaft of separator roller 77*a*, causing paper pickup roller 76 to press against the top surface of recording paper P lying on manual-feed tray 71. In other words, the constitution is such that in accompaniment to driving of the aforementioned motor, paper pickup roller 76 presses against recording paper P lying on manual-feed tray 71 and takes up recording paper P from this manual-feed tray 71; and separation of recording paper P being carried out by paper separator mechanism 77, only one sheet of recording paper P is fed from manual-feed tray 71 to the paper supply path.

Paper Supply Path

Next, the paper supply path (the path internal to hybrid paper supply module 5) for transporting toward main transport path 36 recording paper P that has been taken up by automatic-feed cassette mechanism unit 6 or manual-feed mechanism unit 7, having constitutions as described above, will be described.

As shown in FIG. 2, in the present embodiment, a plurality of hybrid paper supply modules 5, 5, . . . are arranged so as to be stacked together below hybrid device 1. Thus, when respective hybrid paper supply modules 5, 5, . . . are stacked together, primary paths 87 provided at respective hybrid paper supply modules 5, 5, . . . communicate in vertically collinear fashion.

Accordingly, when recording paper P is taken up from the uppermost (i.e., that which is located furthest downstream in the recording paper P transport direction) hybrid paper supply module 51, recording paper P taken up from automatic-feed cassette mechanism unit 6 or manual-feed mechanism unit 7 of this hybrid paper supply module 51 is transported to main transport path 36 by way of primary path 87 at the interior of this hybrid paper supply module 51 (see arrows drawn with solid lines at FIGS. 8 through 11).

On the other hand, when recording paper P is taken up from the hybrid paper supply module 52 that is second from the top (i.e., that is second as counted from an extreme downstream location in the recording paper P transport direction), recording paper P taken up from automatic-feed cassette mechanism unit 6 or manual-feed mechanism unit 7 of this hybrid paper supply module 52 is transported to main transport path 36 by way of primary path 87 at the interior of this hybrid paper supply module 52 and primary path 87 at the interior of hybrid paper supply module 51 (arrows drawn with dashed lines at FIGS. 8 through 11 indicate paper transport direction at the interior of this hybrid paper supply module 51).

In like fashion, when recording paper P is taken up from the hybrid paper supply module 53 that is third from the top (i.e., that is third as counted from an extreme downstream location in the recording paper P transport direction), recording paper P taken up therefrom is transported to main transport path 36 after passing in sequence through primary path 87 at the interior of this hybrid paper supply module 53 and primary paths 87 at the interiors of hybrid paper supply modules 52, 51.

Thus, by passing through primary path(s) 87 at interior(s) of hybrid paper supply module(s) located downstream therefrom in the transport direction, recording paper P can be smoothly transported to main transport path 36 regardless of from which among hybrid paper supply modules 51 through 54 it is that recording paper P is taken up.

Moreover, as has been described above, paper trail edge guide member 64 and paper side edge guide members 65, 65 provided at automatic-feed cassette mechanism unit 6 of each hybrid paper supply module 5 are attached (fixed) to the base of automatic-feed cassette 61. Furthermore, guide members 79, 79 provided at each manual-feed mechanism unit 7 are fixed to manual-feed tray 71. This being the case, automatic-feed cassette mechanism units 6 and manual-feed mechanism units 7 of respective hybrid paper supply modules 5 are each capable of containing or accepting placement therein or thereon of a single, fixed size of recording paper P. That is, each automatic-feed cassette mechanism unit 6 and each manual-feed mechanism unit 7 is set so as to exclusively accept one specific size of recording paper P. For example, at FIG. 2, topmost-stacked hybrid paper supply module 51 might contain A4-size paper, second-highest hybrid paper supply module 52 might contain A5-size paper, third-highest hybrid paper supply module 53 might contain B4-size paper, and bottommost-stacked hybrid paper supply module 54 might contain B5-size paper. But of course the present invention is not limited hereto.

Furthermore, of the respective hybrid paper supply modules 51 through 54 in the present embodiment, the length (i.e., length in the vertical direction when stored) of manual-feed tray 71 of topmost-stacked hybrid paper supply module 51 is set so as to be greater than the length(s) of the other manual-feed trays 71. The length(s) (i.e., dimension(s) in vertical direction when stored) of manual-feed trays 71 of the other hybrid paper supply modules 52 through 54 are approximately equal to the height(s) of module casing(s) 52A, and these manual-feed trays 71 constitute side surface(s) of module casing(s) 52A when stored. However, manual-feed tray 71 of topmost-stacked hybrid paper supply module 51 is such that this manual-feed tray 71, when in its stored state, constitutes the side surface of module casing 52A; but in addition thereto, the top edge portion of manual-feed tray 71 extends further upward than the top edge of module casing 52A so as to be contained within recess 11 formed at the side surface of the hybrid device casing.

Paper Feed Operations

Figure 12:
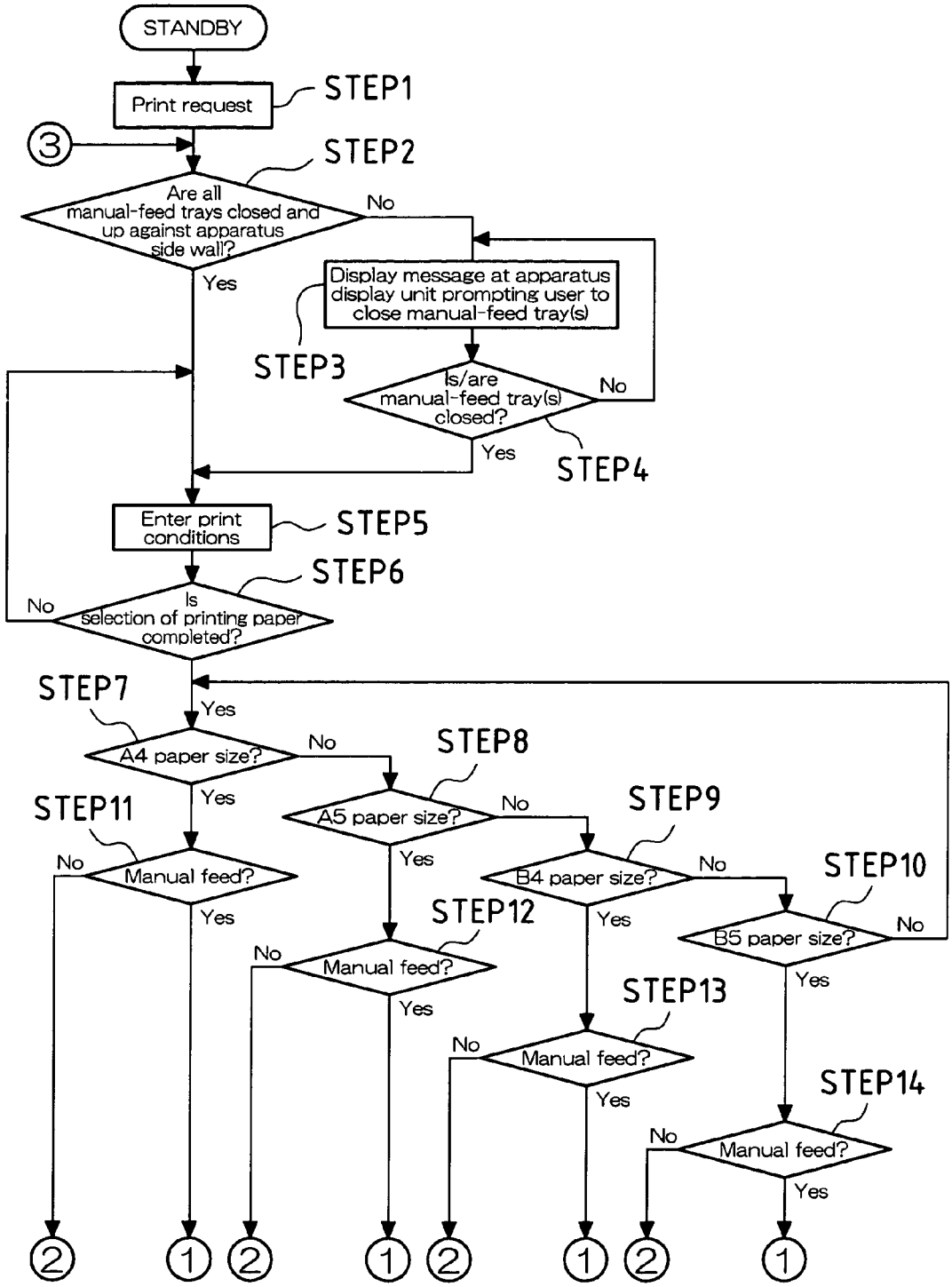
FIG. 12 is a flowchart for explaining some paper feed operations that might be carried out by a hybrid paper supply module.
Figure 13:
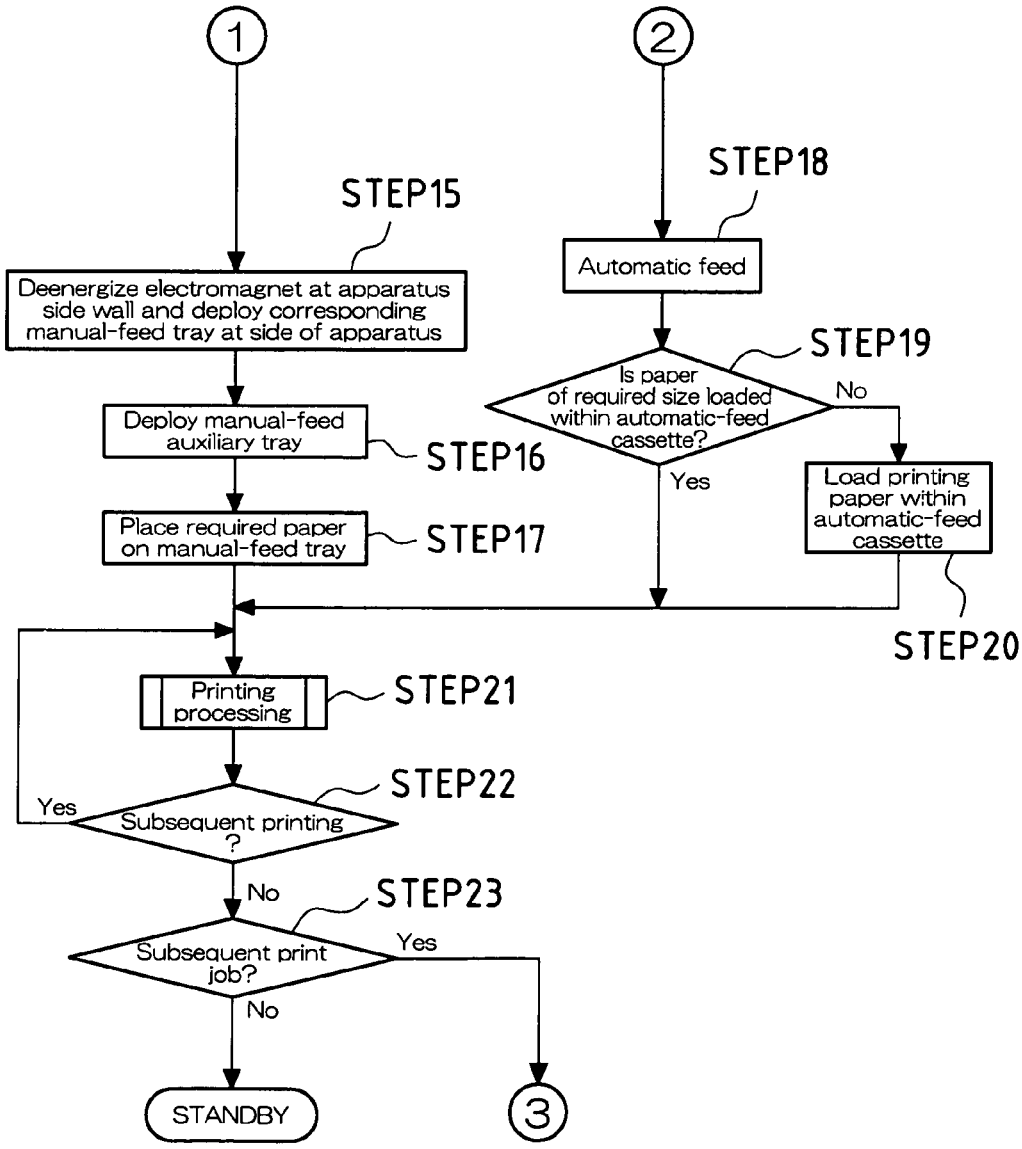
FIG. 13 is a flowchart for explaining some more paper feed operations that might be carried out by a hybrid paper supply module.
Figure 14:
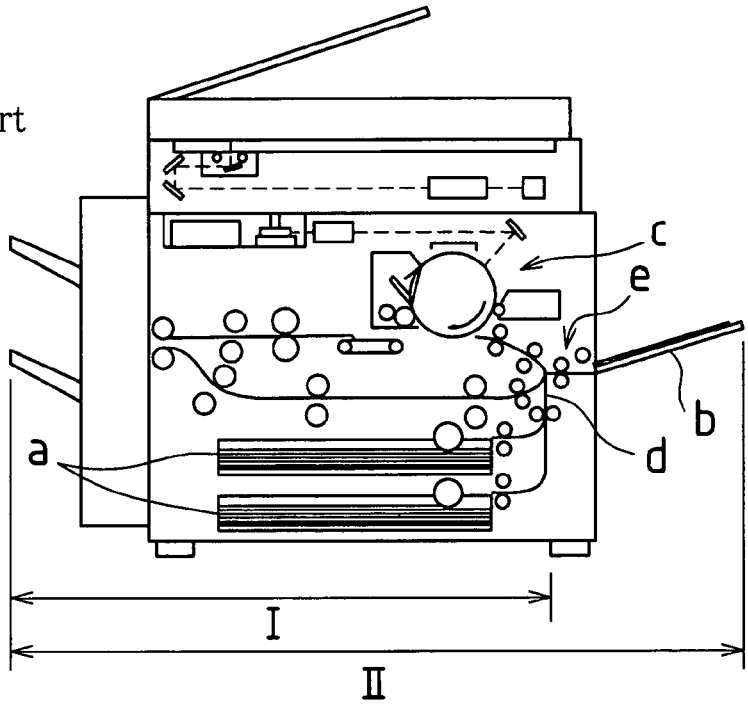
FIG.14 Prior Art
FIG. 14 is a drawing showing in schematic fashion the internal constitution of a typical conventional copier.
Figure 15:
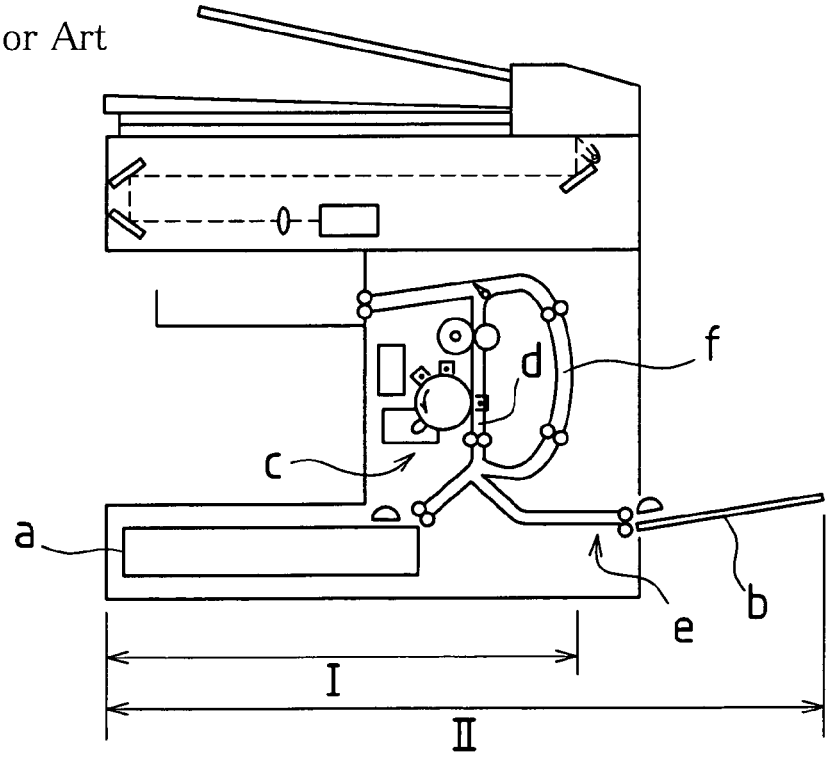
FIG.15 Prior Art
FIG. 15 is a drawing showing in schematic fashion the internal constitution of another conventional copier.

Following the flowcharts of FIGS. 12 and 13, paper feed operations carried out by hybrid paper supply module 5 having the foregoing constitution will next be described.

First, if at STEP1 the user operates a control panel of hybrid device 1 (or operates a host device connected thereto) or there is otherwise a request to carry out printing, then at STEP2 determination is made as to whether manual-feed trays 71 of all manual-feed mechanism units 7 are in stored states; i.e., whether each manual-feed mechanism unit 7 is closed off by the side wall of hybrid paper supply module 5. If any manual-feed tray(s) 71 is/are not in stored state(s), i.e., if manual-feed tray(s) 71 is/are in opened state(s), then processing proceeds to STEP3, at which notice is given at a display unit (display panel) of the apparatus that manual-feed tray(s) 71 should be put into stored state(s) (i.e., that manual-feed mechanism unit(s) 7 should be closed). Furthermore, if at STEP4 it is detected that manual-feed tray(s) 71 has or have been stored (manual-feed mechanism unit(s) 7 has or have been closed), then processing proceeds to STEP5.

The user enters print conditions (STEP5); and upon selection of printing paper (i.e., the type of recording paper P to be used for image formation), the value at STEP6 goes to YES, and processing proceeds to STEP7.

At this STEP7, determination is made as to whether the type of recording paper P selected at print conditions is size A4. If the result of this determination is YES, then processing proceeds to STEP11. If the result of the determination at STEP7 is NO, then processing proceeds to STEP8, at which determination is made as to whether the type of recording paper P selected at print conditions is size A5. If the result of this determination is YES, then processing proceeds to STEP12. If the result of the determination at STEP8 is NO, then processing proceeds to STEP9, at which determination is made as to whether the type of recording paper P selected at print conditions is size B4. If the result of this determination is YES, then processing proceeds to STEP13. If the result of the determination at STEP9 is NO, then processing proceeds to STEP10, at which determination is made as to whether the type of recording paper P selected at print conditions is size B5. If the result of this determination is YES, then processing proceeds to STEP14. If the result of the determination at this STEP10 is NO, then processing returns to STEP7 and determination operations are again carried out.

At the foregoing STEPS 11 through 14, determination is carried out as to whether the selected print conditions are such that the paper supply source is manual-feed mechanism unit 7. If the result of the determination at any STEP is YES, then processing proceeds to STEP15, at which the electromagnet 52*b* for the manual-feed tray 71 corresponding to the paper size obtained as a result of determination is turned OFF, opening manual-feed tray 71 of that specific manual-feed mechanism unit 7 (i.e., manual-feed tray 71 swings down from the side of hybrid paper supply module 5: arrow α in FIG. 9). Furthermore, after, where necessary, carrying out a procedure (arrow β in FIG. 10) in which second tray 75 serving as auxiliary tray is made to pivot (i.e., is opened) and optionally carrying out a procedure (arrow γ in FIG. 11) in which third tray 75A is pulled out therefrom (STEP16), recording paper P is placed on manual-feed tray 71 (STEP17), and processing proceeds to STEP21.

Conversely, if the answer as determined at each of the foregoing STEPS 11 through 14 is NO, then it is determined (STEP18) that the paper supply source pursuant to the selected print conditions is automatic-feed cassette mechanism unit 6; and at STEP19, determination is carried out as to whether there is/are automatic-feed cassette(s) 61 of automatic-feed cassette mechanism unit(s) 6 that contain recording paper P of the required size (recording paper P consistent with the foregoing print conditions). If the result of this determination is YES, then processing proceeds to STEP21; but if the result of this determination is NO, then at STEP20 the user carries out operations for loading of recording paper P consistent with print conditions, following which processing proceeds to STEP21. As examples of this determination as to whether recording paper P consistent with print conditions is loaded therein, paper sensor(s) might be provided at automatic-feed cassette 61, and type(s) (size(s) and/or orientation(s)) of loaded recording paper P might be detected by such sensor(s) and displayed at display panel(s), with determination being carried out pursuant to confirmation of such display by the user; or a warning might be issued to the user in the event that type(s) of recording paper P loaded in automatic-feed cassette 61 as confirmed by hybrid device 1 is/are different from type(s) of recording paper P at the foregoing print conditions, prompting the user to carry out operations for loading of recording paper P consistent with print conditions; and so forth.

Moreover, printing processing is carried out at STEP21; and after paper has been supplied from the desired mechanism unit and image forming has at printing unit 3 been carried out on that recording paper P, operations are carried out for discharge thereof to discharge tray 35.

After printing operations have been carried out on this single sheet of recording paper P, determination is made at STEP22 as to whether there is subsequent printing to be carried out (i.e., whether subsequent print information exists); the operations at STEPS 21 and 22 being carried out in repeated fashion until subsequent print information does not exist. Furthermore, in the event that manual-feed tray 71 becomes depleted of recording paper P during the course of image forming operations when such printing operations (image forming operations) were being carried out using recording paper P placed in or on manual-feed tray 71, recording paper P (recording paper P of the same size as the recording paper P that was being used for printing operations up until that point) contained within automatic-feed cassette mechanism unit 6 at the same hybrid paper supply module 5 is supplied to printing unit 3 and image forming operations are carried out thereon.

Moreover, when subsequent print information no longer exists, determination is carried out at STEP23 as to whether subsequent print job(s) exist; and in the event that there is/are subsequent print job(s), processing returns to STEP2; the foregoing operations being carried out in repeated fashion until subsequent print job(s) no longer exist.

Benefits of Second Embodiment

Because, in the present embodiment, automatic-feed cassette mechanism unit(s) 6 and manual-feed mechanism unit(s) 7 may be incorporated into a single integral hybrid paper supply module 5 as described above, it is possible for manual-feed mechanism unit(s) 7 to be arranged so as to be stacked vertically with respect to flipping transport path(s) 37 and main transport path(s) 36 extending so as to be directed toward printing unit(s) 3 of hybrid device(s) 1, as a result of which it is possible to shorten dimension(s) of hybrid device(s) 1 and achieve reduction in the amount of space required for installation.

Furthermore, this hybrid paper supply module 5 makes it possible to cause the path along which recording paper P taken up from automatic-feed cassette mechanism unit 6 is transported and the path along which recording paper P taken up from manual-feed mechanism unit 7 is transported to intersect at the interior of module 5, and makes it possible to decrease the lengths of the respective paths. This being the case, the length of the overall paper transport path of the apparatus can be shortened, the number of locations at which paper jams can occur can be reduced, and image forming operations at the apparatus can be carried out in stable fashion.

Furthermore, in the present embodiment, in correspondence to image forming condition(s), electromagnet(s) 52*b* is/are turned OFF, causing such specific manual-feed tray(s) 71 to be opened (deployed). This being the case, it is possible for user(s) to easily identify which manual-feed mechanism unit(s) 7 it is or are that should be used by noticing such deployment operation(s) of manual-feed tray(s) 71, it is possible to simplify operation(s) for selection of manual-feed mechanism unit(s) 7, and it is possible to improve image forming apparatus user-friendliness.

Other Embodiments

Whereas in the foregoing embodiment the present invention has been described in terms of an example in which it is applied to a multifunction image forming apparatus (hybrid device) 1 combining the functions of copier, printer, and facsimile machine, the present invention is not limited thereto but may also be applied to an image forming apparatus provided with any one function, and to other image forming apparatuses as well.

Moreover, the present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are, moreover, within the scope of the present invention.

What is claimed is:

1. A hybrid paper supply module comprising:

one or more automatic-feed cassette mechanism unit or units capable of containing one or more recording media for image formation to be carried out at one or more image forming units of one or more image forming apparatuses;

one or more manual-feed mechanism unit or units permitting placement therein or thereon of one or more recording media by one or more users;

one or more automatic-feed paths for transport of one or more recording media taken up from at least one of the automatic-feed cassette mechanism unit or units toward at least one of the recording medium transport path or paths; and one or more manual-feed paths for transport of one or more recording media taken up from at least one of the manual-feed mechanism unit or units toward at least one of the recording medium transport path or paths, wherein said one or more automatic-feed cassette mechanism unit or units and said one or more manual-feed mechanism unit or units constitute a single hybrid paper supply module, when the hybrid paper supply module is stacked together with one or more other hybrid paper supply modules to form one or more multimodule sets, one or more recording medium transport paths passing through at least one interior of at least a portion of the hybrid paper supply modules is or are formed so as to permit transport of one or more recording media toward at least one of the image forming unit or units regardless of from which of the hybrid paper supply modules the one or more recording media is or are taken up, wherein said at least one of the recording medium transport path or paths is formed by a first guide member and a second guide member, the first guide member and the second guide member being installed between said automatic-feed cassette mechanism unit and said manual-feed mechanism so as to extend vertically and to have a prescribed distance therebetween in a horizontal direction, wherein, each of said first guide member and said second guide member has one or more engaging member or members, said engaging member or members engaging with engaging member or members of a first guide member and a second guide member of another hybrid paper supply modules and being mutually positioned when the hybrid paper supply modules are stacked together, and wherein each of said engaging member or members allows the recording medium transport paths of the hybrid paper supply modules to communicate with each other, and wherein a recording medium transport path is provided inside the hybrid paper supply module, between the automatic-feed path and the manual feed-path, and wherein each of said first guide member and said second guide member has a recess formed in a first end thereof and a protrusion formed in a second end thereof, opposite to the first end, such that one of the recess and the protrusion engages with the other of the recess and the protrusion of the another hybrid paper supply module when stacked together with the hybrid paper supply module.

2. A hybrid paper supply module according to claim 1, wherein at least one location at which at least one of the automatic-feed path or paths communicates with at least one of the recording medium transport path or paths and at least one location at which at least one of the manual-feed path or paths communicates with at least one of the recording medium transport path or paths are set so as to not be in mutual opposition.

3. A hybrid paper supply module according to claim 1 or 2, further comprising:

one or more paper takeup mechanisms and one or more paper separator mechanisms, respectively provided in at least one of the automatic-feed path or paths at one or more locations immediately upstream in at least one recording medium transport direction, permitting takeup of only a single recording medium sheet from at least one of the automatic-feed cassette mechanism unit or units; and one or more paper takeup mechanisms and one or more paper separator mechanisms, respectively provided in at least one of the manual-feed path or paths at one or more locations immediately upstream in at least one recording medium transport direction, permitting takeup of only a single recording medium sheet from at least one of the manual-feed mechanism unit or units.

4. A hybrid paper supply module according to claim 1 or 2, further comprising:

one or more transport rollers, provided in the one or more recording medium transport path or paths, for transporting, toward at least one of the other hybrid paper supply module or modules located downstream in at least one recording medium transport direction and/or at least one of the image forming unit or units of at least one of the image forming apparatus or apparatuses, one or more recording media transported to at least one of the recording medium transport path or paths from at least one of the other hybrid paper supply module or modules.

5. A hybrid paper supply module according to claim 1 or 2, further comprising:

one or more paper guides provided at least one of the automatic-feed cassette mechanism unit or units and being of fixed type so as to exclusively accept one specific recording medium size; and one or more paper guides provided at least one of the manual-feed mechanism unit or units and being of movable type so as to permit placement therein or thereon of multiple sizes of recording media.

6. An image forming apparatus, comprising:

a paper supply system formed by stacking together a plurality of paper supply modules according to claim 1 or 2, wherein image formation is carried out on one or more recording media taken up from at least one of the automatic-feed cassette mechanism unit or units or at least one of the manual-feed mechanism unit or units of any one of the paper supply modules and supplied to at least one of the image forming unit or units by way of at least one of the recording medium transport path or paths at least one interior of at least a portion of the hybrid paper supply modules.

* * * * *